US010823393B2

(12) United States Patent
Yamamoto et al.

(10) Patent No.: US 10,823,393 B2
(45) Date of Patent: Nov. 3, 2020

(54) LED ILLUMINATION DEVICE WITH SPEAKER FUNCTION, AND METHOD FOR EXTRACTING LIGHT AND SOUND FROM LED ILLUMINATION DEVICE WITH SPEAKER FUNCTION

(71) Applicant: FURUKAWA ELECTRIC CO., LTD., Tokyo (JP)

(72) Inventors: Syunji Yamamoto, Tokyo (JP); Tetsuji Kubota, Tokyo (JP); Akira Kabumoto, Tokyo (JP); Masahiro Okumura, Shiga (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/739,912

(22) Filed: Jan. 10, 2020

(65) Prior Publication Data

US 2020/0173644 A1 Jun. 4, 2020

Related U.S. Application Data

(63) Continuation of application No. PCT/JP2018/026073, filed on Jul. 10, 2018.

(30) Foreign Application Priority Data

Jul. 11, 2017 (JP) ..... 2017-135168

(51) Int. Cl.
*F21V 33/00* (2006.01)
*H04R 1/02* (2006.01)
(Continued)

(52) U.S. Cl.
CPC ..... *F21V 33/0056* (2013.01); *H04R 1/025* (2013.01); *H04R 17/00* (2013.01); *F21Y 2115/10* (2016.08)

(58) Field of Classification Search
None
See application file for complete search history.

(56) References Cited

U.S. PATENT DOCUMENTS 2,501,968 A * 3/1950 Sassin ..... H05K 11/00 362/253
2009/0196016 A1* 8/2009 Massara ..... H05B 47/00 362/86
(Continued)

FOREIGN PATENT DOCUMENTS

JP 2003-23693 A 1/2003
JP 2007-305472 A 11/2007
(Continued)

OTHER PUBLICATIONS

International Search Report issued in PCT Patent Application No. PCT/JP2018/026073 dated Sep. 18, 2018.

*Primary Examiner* — Elmito Breval
(74) *Attorney, Agent, or Firm* — Marshall, Gerstein & Borun LLP

(57) ABSTRACT

A frame member is attached to an opening in an outer light-reflection plate. The frame member is composed of an inner frame part, and an outer frame part disposed around the inner frame part. A light extraction part is formed between the outer frame part and the inner frame part. The inner frame part is constituted by a separate extraction part that extracts acoustic vibrations and light. A space of the separate extraction part includes, on both ends, a sound intake port on an internal space side where a sound source is disposed, and a sound extraction port formed in the top of the inner frame part so as to open toward the outside of an LED illumination device. The sound intake port and the sound extraction port are formed separated from each other by a prescribed distance, and the space is formed continu-
(Continued)

ously in the inner frame part so as to connect the sound intake port and the sound extraction port.

17 Claims, 14 Drawing Sheets

(51) Int. Cl.
*H04R 17/00* (2006.01)
*F21Y 115/10* (2016.01)

(56) References Cited

U.S. PATENT DOCUMENTS

| | | | | |
|---|---|---|---|---|
| 2010/0316247 | A1* | 12/2010 | Ding | G08B 7/066 381/397 |
| 2012/0230499 | A1* | 9/2012 | Suzuki | H04R 1/025 381/55 |
| 2018/0035187 | A1* | 2/2018 | Cook | H04R 1/028 |

FOREIGN PATENT DOCUMENTS

| | | | |
|---|---|---|---|
| JP | 2009-231128 | A | 10/2009 |
| JP | 2012-19347 | A | 1/2012 |
| JP | 2013-225418 | A | 10/2013 |
| JP | 2015-027329 | A | 2/2015 |
| JP | 2015-102891 | A | 6/2015 |
| JP | 2016-532248 | A | 10/2016 |
| JP | 2017-59446 | A | 3/2017 |

* cited by examiner

LED ILLUMINATION DEVICE WITH SPEAKER FUNCTION, AND METHOD FOR EXTRACTING LIGHT AND SOUND FROM LED ILLUMINATION DEVICE WITH SPEAKER FUNCTION

TECHNICAL FIELD

The present invention relates to an LED illumination device with a speaker function having excellent design and good sound quality, and a method for extracting light and sound from an LED illumination device with a speaker function.

BACKGROUND

Illumination devices that can generate both light and sound at the same time by combining a speaker function and a light illumination function have been developed.

For example, Japanese Unexamined Patent Application Publication No. 2003-023693 (JP-A-2003-023693) proposes a speaker device in which an LED light source is disposed at a supporting tool of a voice coil, and a magnetic field generated by vibration of the voice coil outputs an induced current induced by the vibration of the voice coil to flash the LED light source on and off.

The invention of Japanese Unexamined Patent Application Publication No. 2003-023693 (JP-A-2003-023693) utilizes the LED light source as an indicator function to enjoy flashing of the LED light source that flashes on and off in response to the change in sound pressure of the vibration. The speaker in Japanese Unexamined Patent Application Publication No. 2003-023693 (JP-A-2003-023693) can satisfy audience's taste by flashing the LED light source reacting to up and down of the reproduced sound.

Also, Japanese Unexamined Patent Application Publication No. 2013-225418 (JP-A-2013-225418) proposes a light-bulb shaped light source device including a light source unit, a circuit board installed with a predetermined circuit, a base used for supplying electric power to the light source unit and the circuit, a translucent cover covering the light source unit, an outer fence portion surrounding the circuit board, and a metal-made heat dissipating housing that is thermally connected to the light source unit.

In Japanese Unexamined Patent Application Publication No. 2013-225418 (JP-A-2013-225418), a dynamic speaker is attached directly to an opening portion provided at an end of the light bulb, and, furthermore, a vibration plate is exposed toward an acoustic vibration extraction direction. Also, the light-bulb shaped light source device in Japanese Unexamined Patent Application Publication No. 2013-225418 (JP-A-2013-225418) includes a speaker driver board on which a speaker drive circuit for driving the speaker is installed, and a protruding portion protrudes from the outer fence portion toward the speaker driver board for thermal connection with the predetermined circuit.

Also, a frame body for an LED illumination device includes an inner frame body and an outer frame body. Japanese Unexamined Patent Application Publication No. 2017-59446(JP-A-201759446) proposes a frame body and the like for an LED illumination device in which the inner and outer frame bodies are both formed of sheets made of micro foamed resin.

The invention in Japanese Unexamined Patent Application Publication No. 2017-59446(JP-A-201759446) includes a double-structured frame body, in which an inner frame body is disposed inside the outer frame body. A top face side of the inner frame body serves as a reflection plate. Thus, there is an optical guiding space, which is a first optical guiding space, formed between the top face side of the inner frame body and an opening portion. Similarly, a rear face side of the inner frame body and a top face side of the outer frame body serve as reflection plates. Thus, there is another optical guiding space, which is a second optical guiding space, formed between the rear face side of the inner frame body and the top face side of the outer frame body.

Also, Japanese Unexamined Patent Application Publication No. 2009-231128(JP-A-2009-231128) proposes an LED illumination device including a light source having a plurality of LED chips with different emission wavelengths, a face sheet made of light diffuse reflection sheet formed with many opening portions for light extraction, and a rear sheet made of light diffuse reflection sheet that diffusively reflects light that is diffusively reflected by the face sheet on an opposite side of a light emission surface side of the face sheet.

In Japanese Unexamined Patent Application Publication No. 2009-231128(JP-A-2009-231128), a medium between the face sheet and the rear sheet is air, and each of the opening portions in the face sheet is formed so that light from the light source does not directly emit outside and luminance of light on the light emission surface side is uniform. Also, in the face sheet, the opening portion closer to the light source has a smaller opening size, and an aspect ratio of each opening portion is determined so that light from the light source does not directly emit outside. Also, a thickness of the face sheet increases as approaching an optical axis of the light source, and the aspect ratio of each opening portion is determined so that light from the light source does not directly emit outside. According to the invention in Japanese Unexamined Patent Application Publication No. 2009-231128(JP-A-2009-231128), an LED illumination device that can improve light extraction efficiency while suppressing an occurrence of irregular color can be obtained.

Also, Japanese Unexamined Patent Application Publication No. 2015-027329 (JP-A-2015-027329) proposes a directional light source and sound supplying device for sleeping, which allows a person to fall asleep, to sleep soundly, and to wake up pleasantly in a relaxed environment, while releasing the person from stress of bothering others sleeping around at the time of going to bed, while sleeping, and at the time of waking up.

The directional light and sound source supplying device for sleeping in Japanese Unexamined Patent Application Publication No. 2015-027329 (JP-A-2015-027329) includes a super-directive speaker that transmits voice sound or music, a directive LED illumination light that radiates illumination, a speaker control unit that controls the voice sound or music from the super-directive speaker, an LED illumination control unit that controls the illumination of the directive LED illumination light, a storage portion that stores a voice sound or music pattern that comes out of the super-directive speaker or a pattern of the illumination radiated by the directive LED illumination light, and a pattern control unit that provides a pattern that is previously selected by a sleeper from the patterns stored in the storage portion for the time of going to bed, during sleep, or the time of waking up.

Also, Japanese Unexamined Patent Application Publication No. 2015-102891 (JP-A-2015-102891) proposes a drive assist device and a method for drive assist that can produce warnings according to driving situations when a vehicle deviates from a lane.

The invention in Japanese Unexamined Patent Application Publication No. 2015-102891 (JP-A-2015-102891) includes a control unit that calculates an amount of lane deviation from its own car's driving lane, makes a judgment whether the car is returning to the driving lane or not, determines a warning level, and produces a warning corresponding to the warning level. At this time, a display device shows a light pattern corresponding to the warning level, and the lane deviation warning sound can be produced with the volume corresponding to the warning level by controlling the sound output of the speaker inside the car.

Conventional illumination devices that can emit both light and sound generally have a speaker disposed in front of an illumination device, and this impairs design of the illumination device. Also, to reserve a light extraction area for the illumination device, it is impossible to increase the size of the speaker. Thus, it is compelled to use a small speaker with poor sound quality. Also, to dispose a speaker having a certain size, it is necessary to make the illumination device large.

On the other hand, there is a method in which a speaker is disposed on a rear side of an illumination device. However, conventional illumination devices are generally provided with an optically translucent member for light extraction at the front to suppress a glare of the illumination. Thus, the optically translucent member absorbs and reflects vibration of the speaker on the rear side, which decreases a sound pressure level. Also, vibration propagated from the rear face of the illumination device reflects at obstacles or the like on the rear face of the illumination device and propagates to the front face. Thus, the vibration of a direct vibration plate does not reach directly to the audience. That is, a part where light is extracted and a part where acoustic sound is extracted are not separated, and thus the voice sound cannot be extracted directly. This causes problems such as muffled voice sound and decrease in the sound pressure level.

For example, the LED illumination device in Japanese Unexamined Patent Application Publication No. 2003-023693 (JP-A-2003-023693) has no light extraction member provided and cannot diffuse light. Thus, light is emitted directly from the light source, intensifying the glare. Also, the device emits light at the front of the speaker, basically as an indicator, corresponding to the sound pressure level of the speaker, and thus the illuminance of illumination is insufficient to be used as lighting.

Also, in Japanese Unexamined Patent Application Publication No. 2013-225418 (JP-A-2013-225418), a vibration plate is exposed toward a sound extraction direction, and has a different structure from the claimed invention. As mentioned above, there is a limit to the size of the speaker and it is compelled to sacrifice the sound quality. Also, using a large speaker leads to an increase in size of the device.

Also, the invention in Japanese Unexamined Patent Application Publication No. 2017-59446(JP-A-201759446) is provided with a light extraction member at the light extraction portion and a frame body formed of light reflection plate at the opposite position of the light extraction member. However, there are problems that the vibration of the speaker is absorbed and reflected by the optically translucent member, causing decrease in the sound pressure level.

Also, the invention in Japanese Unexamined Patent Application Publication No. 2009-231128(JP-A-2009-231128) is provided with many slit-shaped opening portions or holes in the light extraction portion, and cross sectional areas and aspect ratio of the opening portions are adjusted to make the luminance of light extracted from the light extraction portion uniform at the light extraction surface. However, there is no light extraction member provided, which intensifies the glare.

Also, the invention in Japanese Unexamined Patent Application Publication No. 2015-027329 (JP-A-2015-027329) selects the pattern from a choice of already stored patterns stored in the storage portion by the sleeper for the time of going to bed, during sleep, or time of waking up, and directly controls lighting of the directional illumination device. However, the invention does not select signals and cannot output warning sounds, or instruction sound from a driving assist system, based on received signals.

Also, although the invention in Japanese Unexamined Patent Application Publication No. 2015-102891 (JP-A-2015-102891) receives predetermined signals and output warning sound, it is not an illumination device with a built-in speaker.

SUMMARY OF THE DISCLOSURE

The present invention was made in view of such problems. Its object is to provide an LED illumination device with a small-sized speaker function having good sound quality, and a method for extracting light and sound from an LED illumination device with a speaker function.

To achieve the above object, a first invention is an LED illumination device with a speaker function including an outer light-reflection plate that is in a concave shape having an opening portion and also serves as an outer frame body, an inner light-reflection plate that is disposed at a position facing the outer light-reflection plate and also serves as an inner frame body, a frame member attached to the opening portion, an LED light source that is disposed in a space formed between facing surfaces of the inner light-reflection plate and the outer light-reflection plate, and a sound source that is disposed in the space at a position different from the position at which the LED light source is disposed or is disposed on an outer surface of the space of the outer light-reflection plate. A light extraction part is formed in the frame member. An opening portion of the outer light-reflection plate and an opening portion of the inner light-reflection plate are fixed to the frame member. The frame member includes, in addition to the light extraction part, a separate extraction part that can extract sound and light from inside the illumination device to outside thereof. The separate extraction part includes a sound and light extraction space with a predetermined length formed inside the illumination device, and sound generated by vibration of the sound source is extracted from the separate extraction part to the outside of the illumination device.

In this case, the LED light source and the sound source may be disposed at different positions on either the inner light-reflection plate or the outer light-reflection plate, or may be disposed on both. When being disposed on both of the inner light-reflection plate and the outer light-reflection plate, the LED light source and the sound source may be disposed not facing each other or may be disposed facing each other. Also, a sound source to be used in this illumination device is preferably a piezoelectric element, although a small-sized dynamic speaker can also be used.

Either the LED light source and a connection portion of the sound source, to which the sound source directly gives vibration, are disposed facing each other at a substantially center of the space, or the LED light source is disposed at a substantially center of an inner surface of the outer light-reflection plate and the sound source is disposed at a substantially center of an outer surface of the outer light-reflection plate. The frame member includes an inner frame part, an outer frame part, and a light extraction part. The light extraction part is formed between the inner frame part and the outer frame part so as to adjoin either the inner frame part or the outer frame part. An opening portion of the outer light-reflection plate is fixed to the outer frame part of the frame member, and an opening portion of the inner light-reflection plate is fixed to the inner frame part. Either the outer frame part or the inner frame part may include the separate extraction part.

By forming an LED light source at a substantially center of a waveguide space made by the inner light-reflection plate and the outer light-reflection plate in this way, it is possible to extract light that is diffusively inter-reflected multiple times from the LED illumination device as uniform indirect light.

Either the LED light source and a connection portion of the sound source, to which the sound source directly gives vibration, are disposed facing each other at a substantially center of the space, or the LED light source is disposed at a substantially center of an inner surface of the outer light-reflection plate and the sound source is disposed at a substantially center of an outer surface of the outer light-reflection plate. The frame member includes the inner frame part and a light extraction part. The light extraction part is formed on outside of the inner frame part so as to adjoin the inner frame part. An opening portion of the outer light-reflection plate is fixed to the light extraction part of the frame member, and an opening portion of the inner light-reflection plate is fixed to the inner frame part. The inner frame part may include the separate extraction part.

Similarly, by forming the LED light source at the substantially center of the waveguide space made by the inner light-reflection plate and the outer light-reflection plate, light that is diffusively inter-reflected multiple times can be extracted from the LED illumination device as uniform indirect light.

The separate extraction part may include a sound and light intake port and a sound and light extraction port either in the outer frame part or in the inner frame part, or on the outside of the inner frame part so as to adjoin the inner frame part. The sound and light intake port is on a side of an inner space in which the sound source and the LED light source are disposed. The sound and light extraction port opens to the outside of the illumination device. The sound and light intake port and the sound and light extraction port may be formed being connected continuously and a predetermined distance away from each other.

The sound source may be disposed at the substantially center of either of the outer light-reflection plate or the inner light-reflection plate, and one or a plurality of the LED light sources may be provided at the substantially center of the reflection plate on which the sound source is not disposed.

The inner light-reflection plate may be disposed on a bottom surface of the inner frame part directly or via a wiring board so as to face the outer light-reflection plate.

The separate extraction part may be formed in the inner frame part, and an inner storage part may be formed inside of the separate extraction part. An inner illumination space may be formed by providing a light reflection plate on an inner surface of the inner storage part, and an inner LED light source may be provided at any position of the inner illumination space. Furthermore, a light extraction member may be disposed at a light extraction part that extracts light from the inner illumination space.

The separate extraction part may be formed in the inner frame part, and an inner storage part may be formed inside of the separate extraction part. A plurality of storage sections may be formed in the inner storage part. An inner LED light source may be disposed in the storage section in a center portion, and one or a plurality of switches may be disposed in the storage sections on the outer sides.

The separated extraction part may include a waveguide space that forms a bent waveguide in which the sound and light intake port is disposed at an angle so as not to be seen from the sound and light extraction port. The separate extraction part may inhibit light transmitted from the inside from emitting directly out of the sound and light extraction port.

A width of the sound and light intake port, a width of the sound and light extraction port, and a width of a sound and light extraction space connecting the sound and light intake port with the sound and light extraction port may all be set between 2 and 10 mm, which is larger than a wavelength of light from the LED light source, smaller than a wavelength of sound taken out of the sound source, and equal to or less than a wavelength of sound wave in a human audible range, so that sound extracted from the sound extraction port can be prevented from interfering with each other inside the sound extraction space.

An inner surface of the sound and light extraction space of the separate extraction part may be formed of a light reflection member.

An inner surface of the sound and light extraction space of the separate extraction part may be formed of a light-absorbing member, or the inner surface of the light extraction space may have an anti-reflection film formed thereon. For example, as a light-absorbing member, general-purpose resin such as PE and PP, ABS resin, PC resin, or the like, which is painted black or grey by using black pigment, may be used.

It is preferable that luminance of light extracted from the light extraction part is stronger than luminance of light extracted from the separate extraction part, and sound extracted from the separate extraction part is louder than sound extracted from the light extraction part. For example, if the inner surface of the sound and light extraction space is covered with the light-absorbing member, it is possible to make the luminance of light extracted from the separate light extraction part 10% or less, or even 5% or less, of the luminance of light extracted from the light extraction part.

The outer light-reflection plate is a light reflection plate made of micro foam resin, which also serves as an acoustic vibration plate. The outer light-reflection plate may be PET resin, PC resin, acrylic resin, or flame-retardant acrylic resin. When an aluminum oxide light reflection plate is taken as a standard plate, a ratio of light reflectivity of the outer light-reflection plate to that of the aluminum oxide light reflection plate may be 90% or more for total reflectivity and 90% or more for diffuse reflectivity.

The light extraction part may be formed, in a planar view, around the inner frame part, in a ring shape or a letter shape such as C shape, D shape, E shape, F shape, L shape, H shape, U shape, θ shape, and Π shape, or may be formed by facing two ring shapes, D shapes, C shapes, I shapes, or the like to each other. In the present invention, the ring shape may include a circular shape, an oval shape, an elliptical shape, and the like.

The illumination device may further include a wiring or a receiver so that when signals are transmitted from an external signal transmitter and received by the wiring or the receiver, a piezoelectric element or a speaker can output sound corresponding to the signals. Also, the illumination device may be an LED illumination device with a speaker function having a small-sized dynamic speaker as a sound source, which is disposed at the substantially center of the outer light-reflection plate. If a small-sized dynamic speaker is used instead of a piezoelectric element as above, sound quality of the speaker can be improved.

According to the first invention, since the sound and light extraction space that can extract sound and light from inside to outside of the illumination device is formed in the separate extraction part, sound generated by vibration of the sound source formed inside the illumination device can be directly extracted from the separate extraction part to the outside of the illumination device. Thus, it is possible to suppress muffling of the sound inside the illumination device.

When the frame member is formed of the inner frame part, the outer frame part, and the light extraction part, the light extraction part is formed between the inner frame part and the outer frame part, and the separate extraction part may be formed either in the outer frame part or in the inner frame part.

Also, when the frame member is formed of the inner frame part and the light extraction part, the light extraction part may be formed on an outer part of the inner frame part and the separate extraction part may be formed in the inner frame part.

Also, since the sound source is disposed inside or on a rear surface side of the illumination device, the sound source does not expose to an outer surface of the illumination device. For this reason, while keeping a sufficient area for the light extraction part, it is possible to have a large vibration region for the sound source. Thus, the LED illumination device with a small-sized speaker with good sound quality can be obtained.

Also, since the separate extraction part includes, on both ends, a sound intake port on an internal space side where the sound source is disposed, and a sound extraction port that opens toward the outside of the illumination device, and a space connecting the sound and light intake port with the sound and light extraction port is formed, this space can be used as a sound and light extraction space that serves as a space for extracting both sound and light.

Also, at a bottom surface of the inner frame part, the inner light-reflection plate is disposed so as to face the outer light-reflection plate. This allows light to be reflected efficiently at the outer and inter light-reflection plates and to be guided to the light extraction part.

Also, the sound source is disposed at the substantially center of one of the outer or inner light-reflection plate, and one or a plurality of the LED light source is provided at the substantially center of the reflection plate on which the sound source is not disposed. This can keep a reflection area for the outer or the inner light-reflection plate efficiently. Also, a plurality of the LED light sources can be provide at predetermined positions according to the size and the shape of the illumination device. When a plurality of the LED light sources are provided, an arrangement of the LED light sources is preferably symmetric to maybe not the substantial center but the center. With such an arrangement, uniform light can be extracted from the light extraction part.

Also, an inner storage part is formed further inside of the separate extraction part, an inner LED light source is provided inside the inner storage part, and a light reflection plate is provided on an inner surface of the inner storage part so that an inner illumination space can be formed. Thus, light can be extracted efficiently and separately from both the inner illumination space and the light extraction part.

Also, a plurality of storage sections are formed inside the inner storage part, an inner LED light source is disposed in the storage part in the center portion, and switches are disposed in the storage sections on the outer sides so that light can be extracted efficiently and separately from both the inner illumination space and the light extraction part, and, in addition, the switches that control the illumination device can be disposed on the front face of the illumination device.

Also, the separate extraction part includes a space that forms a bent waveguide in which the sound intake port is disposed so as not to be seen from the sound and light extraction port. Thus, the extraction part can inhibit light that is guided from the sound and light intake port inside the illumination device from emitting directly out of the sound and light extraction port to the outside. In this case, the cross sectional shape of the space that forms the bent waveguide can be any one of an L shape, U shape, V shape, and S shape, for example.

The widths of the sound and light intake port, the sound and light extraction port, and the sound and light extraction space connecting the sound and light intake port with the sound and light extraction port can be set between 2 to 10 mm, which is longer than a wavelength of light from the LED light source and is shorter than a wavelength of sound wave extracted from the sound source and than wavelengths in a human audible range. Since the opening width is smaller than the wavelength of the sound, interference and reflection as waves can be suppressed. Also, this enables to prevent the sound taken out of the sound and light extraction port from interfering with each other inside the sound and light extraction space.

In particular, by appropriately setting a distance between the sound and light intake port and the sound and light extraction port and a ratio of the width of the sound and light intake port to the width of the sound and light extraction port of the separate extraction part, luminance of light extracted to the outside of the illumination device can be controlled. Increasing the ratio of the width of the sound and light intake port to the width of the sound and light extraction port or increasing a number of times of bending of the space continuously connecting the sound and light intake port with the sound and light extraction port can decrease the luminance of light extracted from the sound and light extraction port.

Also, forming the inner surface of the sound and light extraction space of a light-reflective member can control the luminance of light emitting from the sound and light extraction space.

Similarly, forming the inner surface of the sound and light extraction space of a light-absorbing member or forming an anti-reflection film on the inner surface of the light extraction space can control the luminance of light emitting from the sound and light extraction space.

Also, by making the luminance of light extracted from the light extraction part stronger than the luminance of light extracted from the separate extraction part, and by making the sound extracted from the separate extraction part louder than the sound extracted from the light extraction part, an illumination device that excels in design and decorativeness can be obtained.

As a sound source, a piezoelectric element or a speaker can be chosen. Here, a dynamic speaker has less distortion in a low sound range and has a characteristic of being resistant to a large input when compared to a piezoelectric element. Thus, a dynamic speaker excels in sound quality compared to a piezoelectric speaker.

Also, if the sound source is a dynamic speaker with a dumper or an edge, and, in addition, a vibration plate for the sound source is formed of a micro foam resin, the sound quality can be further improved compared to the piezoelectric speaker.

Also, if the light diffusion reflectivity of the outer light-reflection plate is 90% or more, it is possible to extract uniform light, and, in addition, since the diffusion reflectivity is high, flickering of light can be suppressed when the light reflection plate is vibrated to use the speaker.

Here, the light reflection plate that also serves as an acoustic vibration plate vibrates due to vibration when the speaker is used. At this time, for example, if a light-reflection plate or the like made of metal having a high regular reflectance is used, a fluctuation in luminance distribution with regard to time and space of the surface of the reflection plate may occur due to small vibrations of the light-reflection plate. This may cause flickering of light due to change in directions or intensity of reflected light.

On the other hand, if the light reflection plate is made of micro foamed resin, the light refection plate has an extremely high diffusion reflectivity. That is, a distribution of reflection directions against the light entering directions is smoother compared to conventional metal plates or the like. Thus, even when the light reflection plate vibrates, the change in directions or intensity of reflected light due to the fluctuation of luminance distribution with regard to time and space of the surface of the reflection plate may hardly occur. As a result, flickering of reflected light at the time of vibration can be reduced. In this way, flickering of the illumination due to vibration can be prevented so that the light-reflection plate can be used as a vibration plate, and an LED illumination device with a small-sized and lightweight speaker function can be obtained.

Also, if the light extraction part is formed, in a planar view, around the inner frame part, in a ring shape or any of the letter shapes such as C shape, D shape, E shape, F shape, L shape, H shape, U shape, θ shape, and Π shape, or are formed by facing two ring shapes, D shapes, C shapes, I shapes, or the like to each other, the illumination device excels in design and light can be extracted uniformly from an outer periphery of the illumination device.

Also, if the illumination device includes a receiver and the piezoelectric element or the speaker therein can output voice sound corresponding to signals that are transmitted from the external signal transmitter and received by the receiver, it is possible to transmit and receive sound voice signals or music signals using a wireless technology such as BlueTooth (a registered trademark). Thus, there is no need to connect the external signal transmitter to the illumination device using wires.

Also, if the illumination device is connected with the external signal transmitter using a wiring, it is still possible for the piezoelectric element or the speaker to output sound voice corresponding to the signals received by the external signal transmitter. At this time, by setting the size of the openings of the sound and light intake port and the sound and light extraction port to the predetermined widths, the sound extracted from the sound and light extraction part of the illumination device hardly experiences reflection or interference, and thus clear sounds can be obtained.

Second invention is a method for extracting light and sound from an LED illumination device with a speaker function. The method uses the LED illumination device with a speaker function according to the first invention. The inner light-reflection plate and the outer light-reflection plate are disposed so as to face each other to form a waveguide space, and light inter-reflected at the inner light-reflection plate and the outer light-reflection plate can be extracted as indirect light from the light extraction part. A separate extraction part of the illumination device is formed either in the inner frame part or in the outer frame part and includes a sound and light intake port, which is on an internal space side where a sound source is disposed, and a sound and light extraction port, which opens toward an outside of the illumination device. The sound and light intake port and the sound and light extraction port are disposed a predetermined distance away from each other, and a sound and light extraction space that continuously connects together the sound and light intake port and the sound and light extraction port is formed. The separate extraction part is a waveguide space forming a bent waveguide, in which the sound and light intake port is disposed at an angle so as not to be seen from the sound and light extraction port. Sound generated by vibration of the sound source is extracted through the sound and light extraction space from the separate extraction part directly to the outside. Light from a light source of the illumination device is diffusively reflected in the bent waveguide, and then extracted as indirect light from the bent waveguide of the separate extraction part.

Third invention is a method for extracting light and sound using an LED illumination device with a speaker function. The method uses the LED illumination device with a speaker function according to the first invention. The inner light-reflection plate and the outer light-reflection plate are disposed so as to face each other to form a waveguide space, and light inter-reflected at the inner light-reflection plate and the outer light-reflection plate can be extracted as indirect light from the light extraction part. A separate extraction part of the illumination device is formed in the inner frame part and includes a sound and light intake port, which is on an internal space side where the sound source is disposed, and a sound and light extraction port, which opens toward an outside of the illumination device. The sound and light intake port and the sound and light extraction port are disposed a predetermined distance away from each other, and a sound and light extraction space that continuously connects together the sound and light intake port and the sound and light extraction port is formed. The separate extraction part is a waveguide space forming a bent waveguide, in which the sound and light intake port is disposed at an angle so as not to be seen from the sound and light extraction port. Sound generated by vibration of the sound source is extracted through the sound and light extraction space from the separate extraction part directly to the outside. Light from a light source of the illumination device is diffusively reflected in the bent waveguide, and then extracted as indirect light from the bent waveguide of the separate extraction part.

Here, by not providing the outer frame part on the outer part of the light extraction part, the light extraction part and the outer light-reflection plate can be fixed to each other directly. This can make the light extraction part larger, and thus a lighting region of light extracted from the illumination device can be enlarged and the light can be extracted with wider angles.

According to this method for extracting sound and light from the illumination device, direct or indirect light can be extracted from a center part of the illumination device, and indirect light can be extracted from an outer periphery part of the illumination device. Furthermore, sound can be extracted directly from the inside through the separate extraction part to the outside of the illumination device.

Also, by forming the inner surface of the sound and light extraction space of a light reflection member, the luminance of light emitted from the light extraction space can be controlled. Alternatively, by forming the inner surface of the sound and light extraction space of a light-absorbing member or forming an anti-reflection film on the inner surface of the sound and light extraction space, the luminance of light emitting from the sound and light extraction space can be controlled.

The present invention can provide an LED illumination device with a small-sized speaker function having good sound quality, and a method for extracting light and sound from the LED illumination device with the speaker function.

DETAILED DESCRIPTION OF SOME EMBODIMENTS

Figure 1:
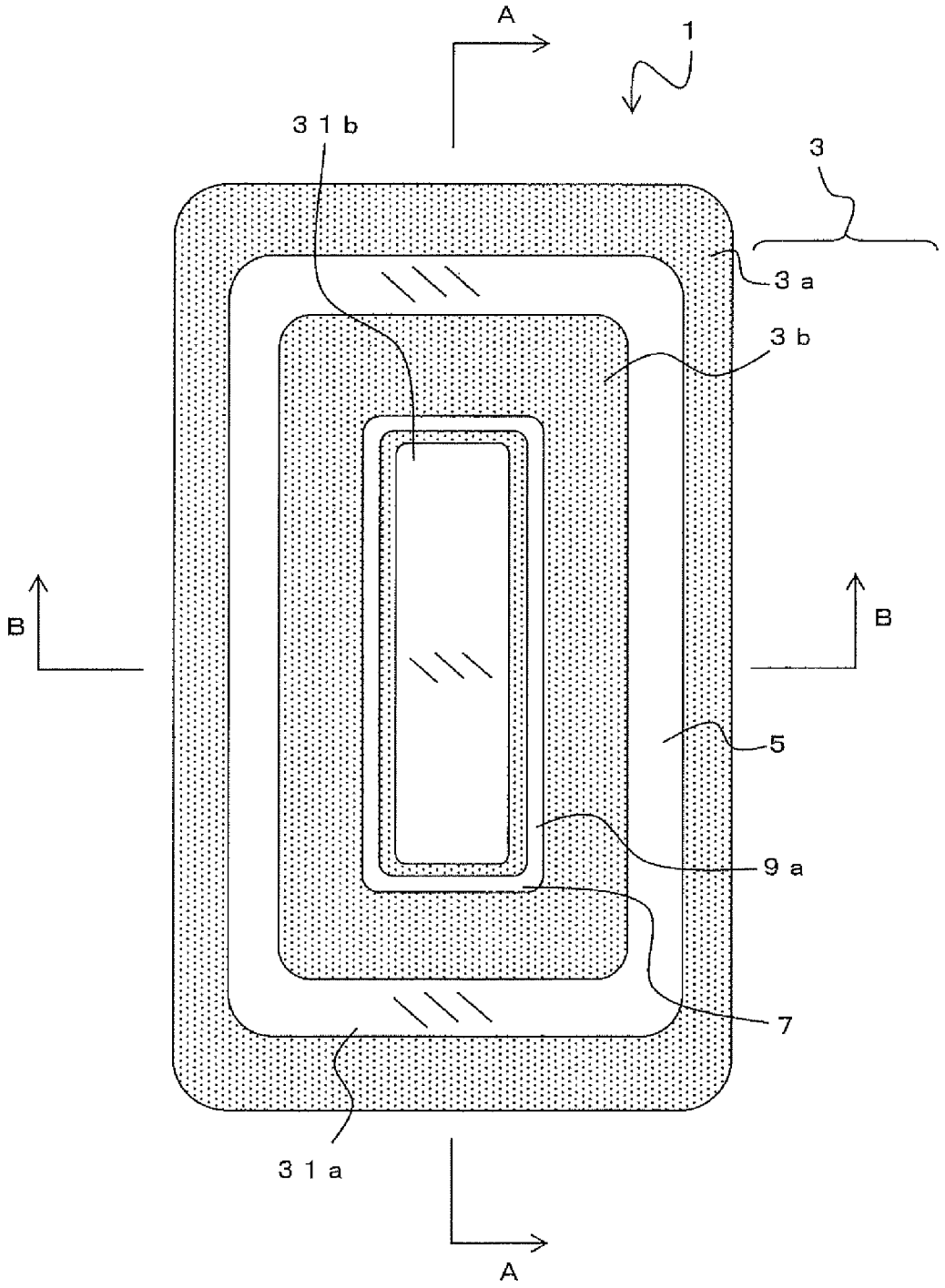
FIG. 1 is a plan view showing an LED illumination device 1.
Figure 2:
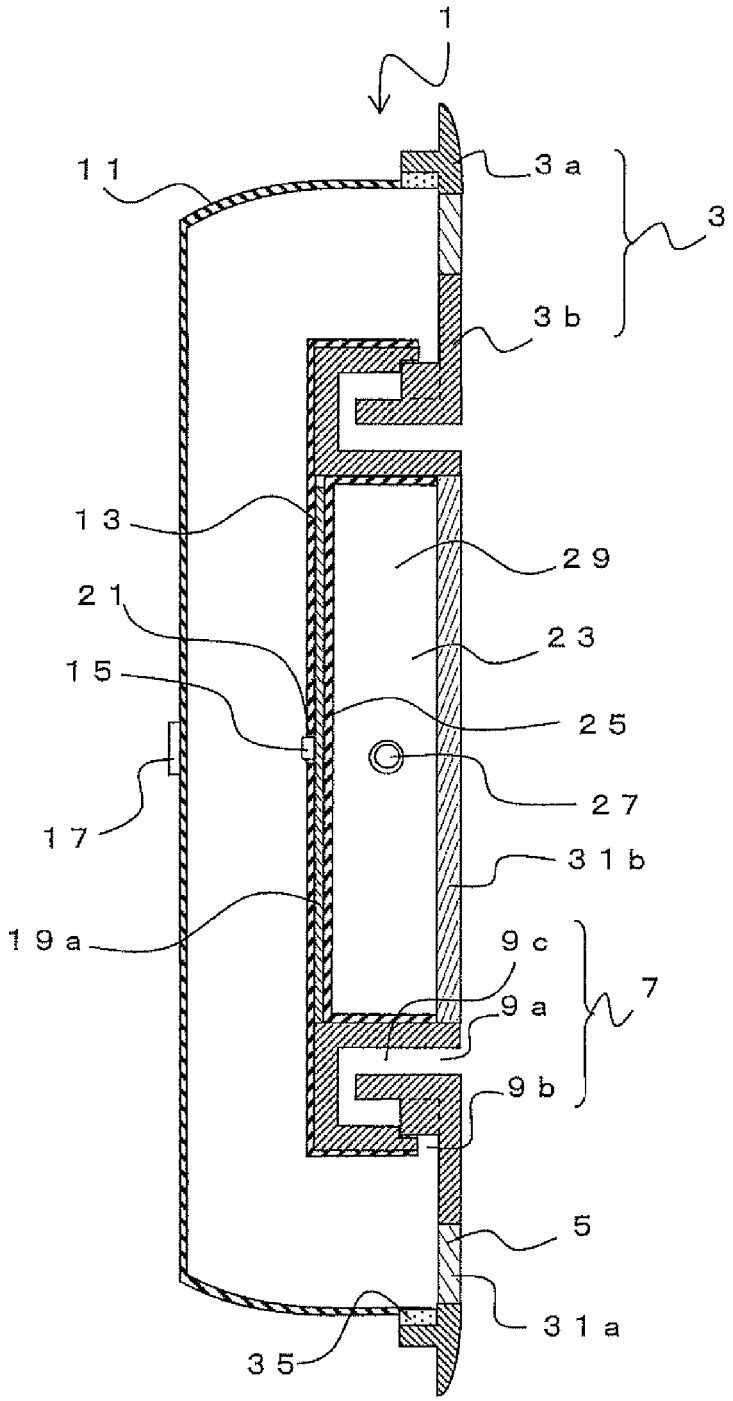
FIG. 2 is a cross sectional view taken along A-A line in FIG. 1.
Figure 3:
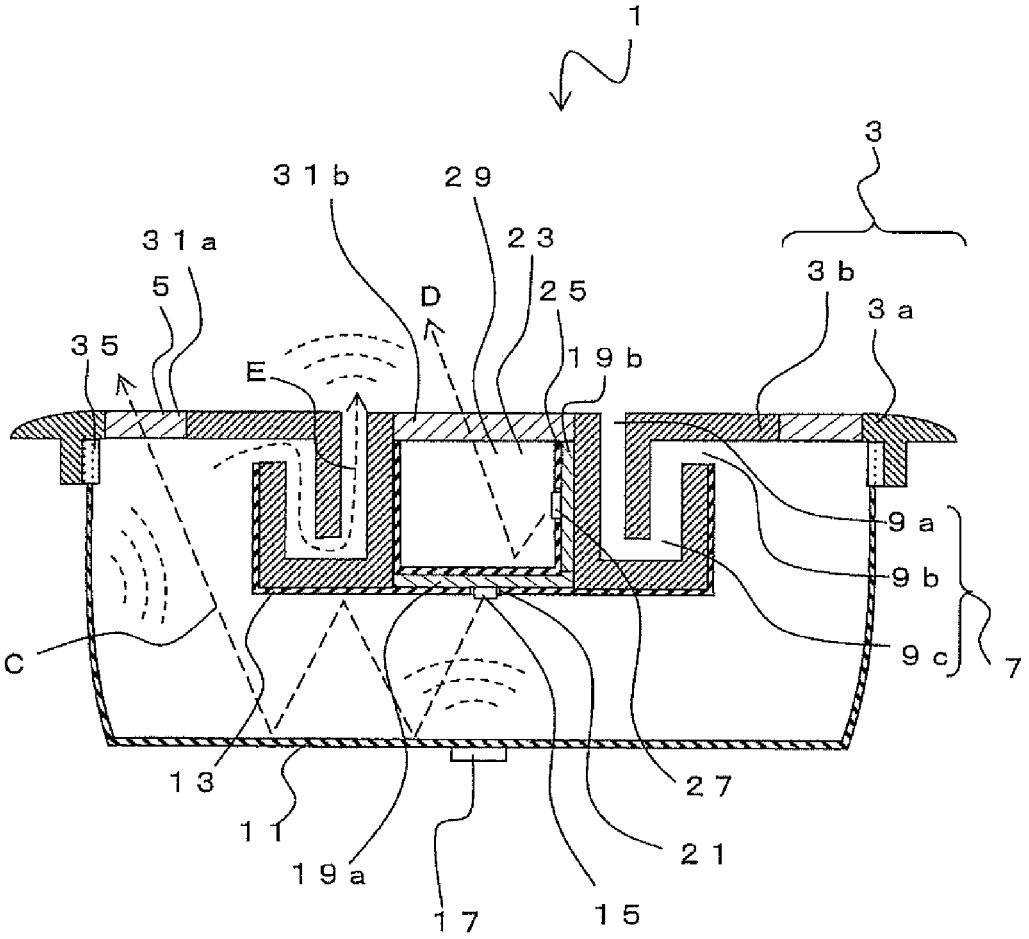
FIG. 3 is a cross sectional view taken along B-B line in FIG. 1.

Hereinafter, some embodiments of the present invention will be described with reference to the accompanying drawings. FIG. 1 is a plan view showing an LED illumination device 1, FIG. 2 is a cross sectional view taken along A-A line in FIG. 1, and FIG. 3 is a cross sectional view taken along B-B line in FIG. 1. The LED illumination device 1 mainly includes a frame member 3, an outer light-reflection plate 11, an LED light source 15, a sound source 17, and so on. The LED illumination device 1 is an LED illumination device with a speaker function.

The outer light-reflection plate 11 has a concave shape with an opening portion on one side. The outer light-reflection plate 11 also serves as an outer frame body of the LED illumination device 1. The frame member 3 is attached to the opening portion of the outer light-reflection plate 11. The outer light-reflection plate 11 is joined to the frame member 3 via an anti-vibration member 35. The anti-vibration member 35 suppresses transmission of vibration from the outer light-reflection plate 11 to the frame member 3. The frame member 3 includes an inner frame part 3*b* and an outer frame part 3*a* that is disposed around the inner frame part 3*b*. The frame member 3 is formed of thermoplastic resin, for example.

Here, the anti-vibration member 35 may be provided, or may not be provided. In the LED illumination device 1, the LED light source 15 is provided at a substantially center of an inner light-reflection plate 13 with a light emission surface facing the outer light-reflection plate 11, and the sound source 17 is provided at a substantially center of an outer surface of the outer light-reflection plate 11. Providing the sound source 17 on the outer surface of the outer light-reflection plate 11 in this way can reduce absorption of light by the sound source 17 and, at the same time, can increase effective areas of the light-reflection plate, which forms an optical guiding space formed by the inner light-reflection plate 13 and the outer light-reflection plate 11.

A light extraction part 5 is formed between the outer frame part 3*a* and the inner frame part 3*b*. That is, the frame member 3 has the light extraction part 5 formed. The light extraction part 5 is a part where light from an inside of a hollow formed by the outer light-reflection part 11 is extracted. The light extraction part 5 is formed, in a planar view, as a ring shape around the inner frame part 3*b*. Alternatively, the light extraction part 5 may be in a C shape instead of a ring shape. That is, although the light extraction part 5 is formed in a ring shape or in a C shape around the inner frame part 3*b* in a planar view, for example, it is also possible to make the light extraction part 5 in other shapes.

The light extracting part 5 is formed, between the inner frame part 3*b* and the outer frame part 3*a*, continuously from an outer side of the inner frame part 3*b* toward an inner side of the outer frame part 3*a* while being in contact with the inner frame part 3*b*. That is, the light extracting part 5 is formed between the inner frame part 3*b* and the outer frame part 3*a* so as to continuously adjoin either the inner frame part 3*b* or the outer frame part 3*a*. At the opening portion of the outer light-reflection plate 11, the outer light-reflection plate 11 is fixed to the outer frame part 3*a* of the frame member 3. Here, although the illustrations in FIGS. 1 to 3 show a case in which the light extraction part 5 is formed between the outer frame part 3*a* and the inner frame part 3*b*, the present invention is not limited thereto.

Figure 4:
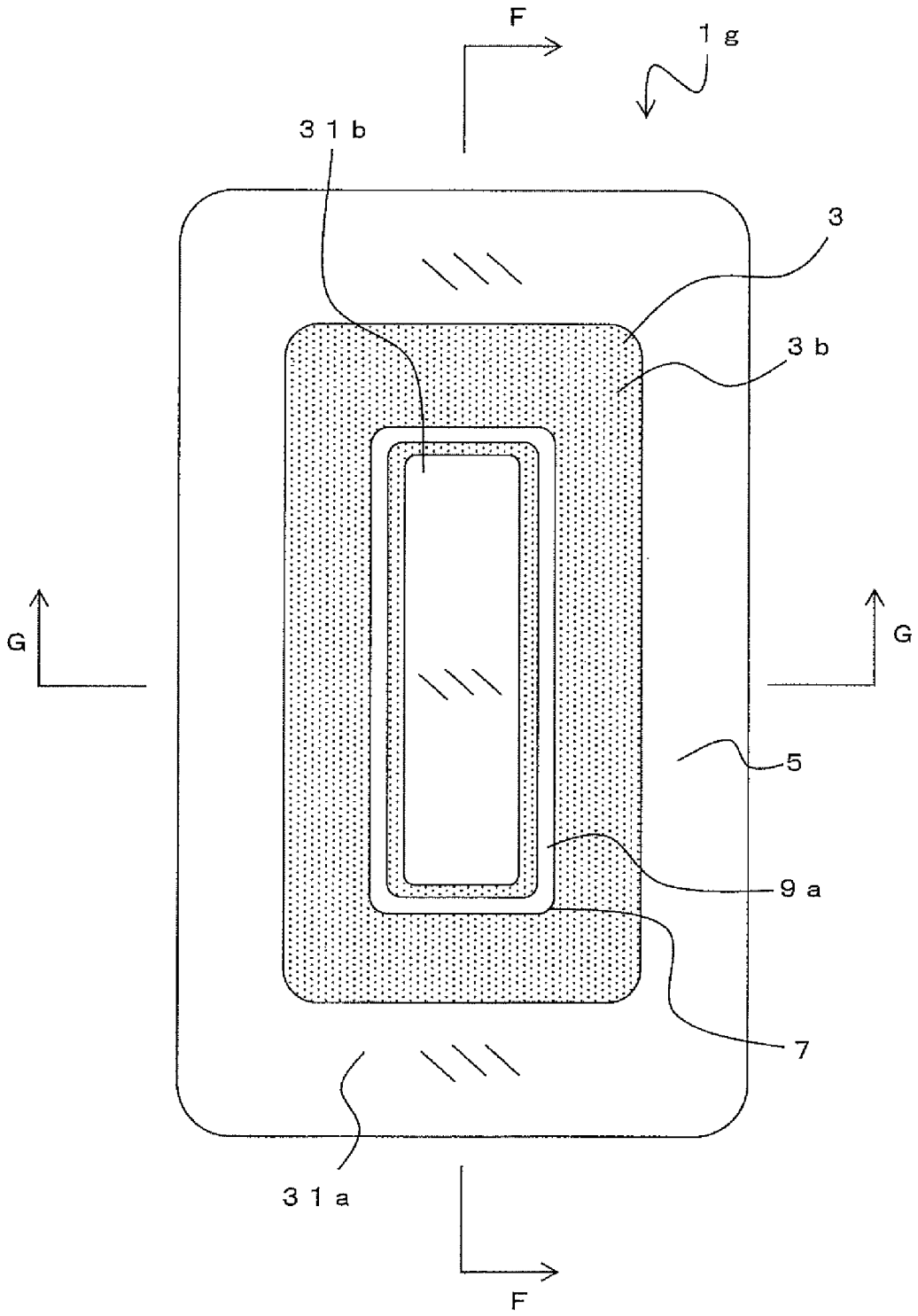
FIG. 4 is a plan view showing an LED illumination device 1*g*.
Figure 5:
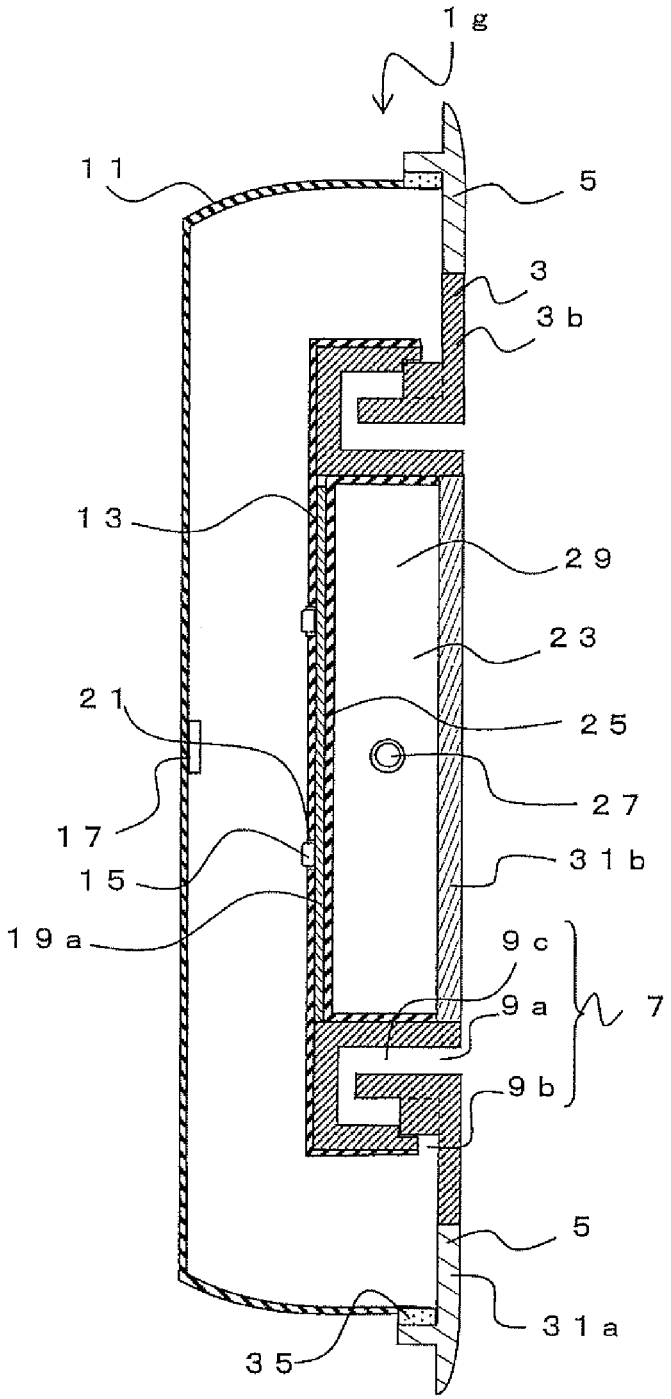
FIG. 5 is a cross sectional view taken along F-F line in FIG. 4.
Figure 6:
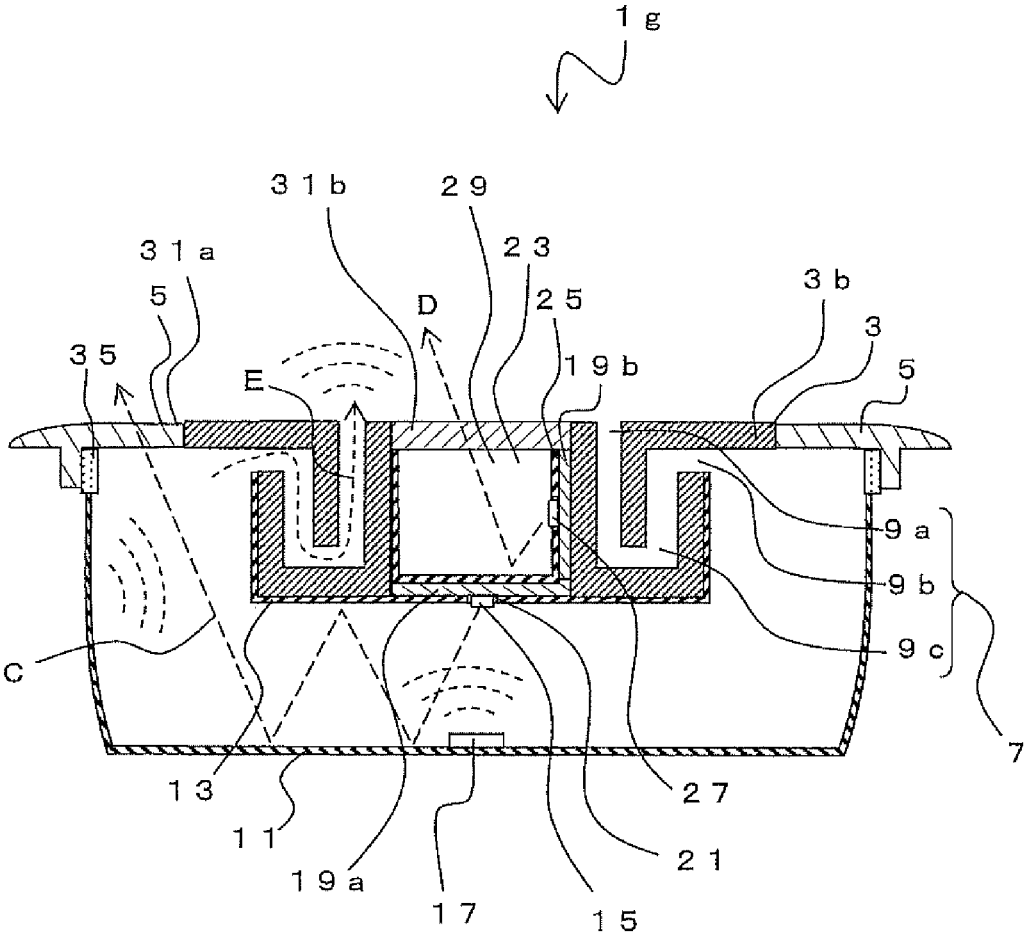
FIG. 6 is a cross sectional view taken along G-G line in FIG. 4.

FIG. 4 is a plan view of an LED illumination device 1*g*, FIG. 5 is a cross sectional view taken along F-F line in FIG. 4, and FIG. 6 is a cross sectional view taken along G-G line in FIG. 4. The LED illumination device 1*g* is approximately similar to the LED illumination device 1 except that the LED illumination device 1*g* has no outer frame part 3*a* and the light extraction part 5 is fixed with the outer light-reflection part 11. That is, the frame member 3 of the LED illumination device 1*g* is formed of the inner frame part 3*b* and the light extraction part 5. Also, the above-mentioned LED illumination device 1 has the single LED light source 15, whereas the LED illumination device 1*g* has a plurality of the LED light sources 15 that are disposed on a surface of the inner light-reflection plate 13, which is opposite to the outer light-reflection plate 11. Furthermore, the sound source 17 is disposed at the substantially center of the outer surface of the outer light-reflection plate 11 in the LED illumination device 1, whereas the sound source 17 is disposed at a substantially center of an inner surface of the outer light-reflection plate 11. Thus, the LED illumination device 1*g* is different from the LED illumination device 1 in the number of the LED light source 15 and in the position of the sound source.

Like the LED illumination device 1*g* shown in FIGS. 4 to 6, by directly fixing the light extraction part 5 of the frame member 3 to the opening portion of the outer light-reflection plate 11, the frame member 3 may be formed of the light extraction part 5 and the inner frame part 3*b* without using the outer frame part 3*a*. The light extraction part 5 is formed on an outer part of the inner frame part 3*b* so as to continuously adjoin the inner frame part 3*b*. The illumination device having such the structure can also extract light from the light extraction part 5 in the same way as the case in which the outer frame part 3*a* exists. In this case, compared to the LED illumination device 1 in which the outer frame part 3*a* exists, an area of the light extraction part 5 is larger, and thus it is possible to extract light at wider angles from the LED illumination device 1*g*.

Also, a planar-view shape of the light extraction part 5 is not limited to the above-mentioned shape and can be in various shapes. Other than the above-mentioned ring shape or C shape, the shape of the light extraction part 5 may be in a letter shape such as D shape, E shape, F shape, L shape, H shape, U shape, θ shape, or Π shape. Alternatively, the light extraction part 5 can be formed by facing each other two ring shapes, D shapes, C shapes, I shapes, or the like.

A light extraction member 31*a* is provided in the light extraction part 5. A material for the light extraction member 31*a* can be selected, for example, from a group of acrylic resin, silicone resin, epoxy resin, and polycarbonate resin, or a transparent or translucent resin plate or a glass plate. The light extraction member 31*a* can diffuse the light emitted from the inside and reduce glare.

The inner frame part 3*b* includes, other than the light extraction part 5, a separate extraction part 7 for extracting sound and light. The separate extraction part 7 is formed by combining two members that face each other, and a sound and light extraction space 9*c* is formed between the two members. To prevent the members from closely contacting with each other and to keep not blocking the sound and light extraction space 9*c* and a predetermined width for the sound and light extraction space 9*c*, the members are in contact with each other via a protrusion or the like at a part of a circumference direction (see FIG. 2). Also, the two members are joined together with a fitting claw, a bolt, or the like, which is omitted in the drawing, while keeping the sound and light extraction space 9*c*.

The sound and light extraction space 9*c* in the separate extraction part 7 includes a sound and light intake port 9*b* and a sound and light extraction port 9*a* on both ends. The sound and light intake port 9*b* is on a side of an inner space where the sound source 17 is disposed, and the sound and light extraction port 9*a* is formed at an upper part of the inner frame part 3*b* opening toward the outside of the LED illumination device 1. The sound and light intake port 9*b* and the sound and light extraction port 9*a* are formed a predetermined distance away from each other, and the sound and light extraction space 9*c*, which continuously connects the sound and light intake port 9*b* with the sound and light extraction port 9*a*, is formed in the inner frame part 3*b*. That is, the inner space of the LED illumination device 1 is connected with the outer space thereof through the sound and light extraction space 9*c*.

The separate extraction part 7 serves as a sound extraction space and a light extraction space, which can extract sound and light from the inside of the LED illumination device 1 to the outside. That is, the separate extraction part 7 forms the sound and light extraction space 9*c*, which has a predetermined length and can extract the sound and light from the inside of the LED illumination device 1 to the outside, inside of the LED illumination device 1. Thus, the sound generated by vibration of the sound source 17 can be extracted from the separate extraction part 7 directly to the outside. The separate extraction part 7 will be described in detail below.

The inner light-reflection plate 13 is disposed on a bottom face (an inner face side) of the inner frame part 3*b* so as to face the outer light-reflection plate 11 directly or via a wiring board 19*a*. That is, the inner light-reflection plate 13 is disposed at a position opposite to the outer light-reflection plate 11. The inner light-reflection plate 13 also serves as an inner frame body. An opening portion of the inner light-reflection plate 13 is fixed to the inner frame part 3*b*. That is, the opening portions of the outer light-reflection plate 11 and the inner light-reflection plate 13 are fixed to the frame member 3.

The sound source 17 is disposed at substantially center of the inner surface of the outer light-reflection plate 11. Also, a cavity 21 is provided at a substantially center of the inner light-reflection plate 13, and the LED light source 15 is provided in the cavity 21 so as to face the outer light-reflection plate 11. That is, the LED light source 15 and the sound source 17 are disposed on the positions of either facing surfaces of the inner light-reflection plate 13 and the outer light-reflection plate 11. For the case in which the sound source 17 is disposed on the outer surface of the outer light-reflection plate 11, if a portion that is directly joined to the sound source 17 and directly vibrates is disposed at a position that is opposite to the LED light source 15, then it is considered that the sound source 17 is disposed inside a space formed between the facing surfaces of the inner light-reflection plate 13 and the outer light-reflection plate 11 at the position opposite to the LED light source 15. Also, not only disposing the sound source 17 and the LED light source 15 facing each other, but the LED light source 15 may be disposed on the inner surface of the outer light-reflection plate 11, and the sound source 17 may be disposed on the outer surface of the outer light-reflection plate 11.

As above, the LED light source 15 is disposed in a space formed between the facing surfaces of the inner light-reflection plate 13 and the outer light-reflection plate 11, and the sound source 17 is disposed at a different position from the LED light source 15, which is in the space formed between the facing surfaces of the inner light-reflection plate 13 and the outer light-reflection plate 11, or at the reverse surface of the outer light-reflection plate 11. That is, either the LED light source 15 and a connection portion of the sound source 17, to which the sound source 17 directly gives vibration, may be disposed facing each other at a substantially center of the space that is formed between the facing surfaces of the inner light-reflection plate 13 and the outer light-reflection plate 11, or the LED light source 15 is disposed at a substantially center of an inner surface of the outer light-reflection plate 11 and the sound source 17 may be disposed at a substantially center of an outer surface of the outer light-reflection plate 11.

The LED light source 15 is connected with the wiring board 19*a*. As mentioned above, the inner light-reflection plate 13 covers the wiring board 19*a*. Thus, only an emission surface of the LED light source 15 is exposed from the cavity 21 to the inner space. There may be the single LED light source 15 as shown in FIG. 2, or there may be a plurality of the LED light sources 15 as shown in FIG. 5. The wiring board 19*a* is a control board that controls the LED light source 15 and the like, and is a rigid board such as a glass epoxy board. Also, the sound source 17 is a piezoelectric element or a speaker.

Here, the outer light-reflection plate 11 and the inner light-reflection plate 13 are preferably made of micro foam resin. In particular, the outer light-reflection plate 11 is preferably a light-reflection plate made of micro foam resin, which also serves as an acoustic vibration plate. A micro foam resin plate is formed of a micro foam resin sheet (a porous member including many micro bubbles). The micro foam resin sheet used in the present invention is an insulating resin sheet having a foamed layer in the middle and non-foamed layers on both sides thereof. Here, the foam layer is a layer in which bubbles are generated by foaming.

Also, the micro foam resin plate has an extremely low density, and thus its harmonic distortion is extremely small. Also, the micro foam resin plate can make the outer light-reflection plate 11 and the inner light-reflection plate 13 lightweight because of its low density. Also, when the micro foam resin plate is used as the acoustic vibration plate, reproduction sound pressure characteristic (sound pressure level) is excellent. Here, an average diameter of bubbles in the micro foam resin plate is preferably 20 μm or less, and more preferably 10 μm or less.

Here, if the average diameter of bubbles is too small, light transmittance is increased and reflectivity is decreased. Also, if the average diameter of bubbles is too large, diffuse reflectivity is decreased. Thus, the average diameter of bubbles is required to be between 0.2 μm and 20 μm, and more preferably, between 0.5 μm and 10 μm.

As optical characteristics of the outer light-reflection plate 11 and the inner light-reflection plate 13 (the micro foam resin plate) within a visible light region of wavelengths between 450 nm and 650 nm, the light reflectivity ratio against an aluminum oxide light reflection plate, which is used as a standard plate, preferably satisfies 90% or more for the total reflectivity and 90% or more for diffuse reflectivity. It is more preferable that both the total reflectivity and the diffuse reflectivity satisfy 95% or more.

Preferably, the micro foam resin plate is formed of at least one of PET resin (polyethylene terephthalate resin), PC resin (polycarbonate resin), flame resistant PC resin, acrylic resin, flame resistant acrylic resin, or PMMA resin (polymethyl methacrylate resin).

An inner storage part 23 is formed further inside (on a side of the center) of the separate extraction part 7 that is formed inside the inner frame part 3*b*. On an inner surface of the inner storage part 23, a light-reflection plate 25 is provided and an inner illumination space 29 is formed. An inner LED light source 27 is provided at any position within the inner illumination space 29. The inner LED light source 27 is connected with a wiring board 19*b*. The inner LED light source 27 provided inside the inner storage part 23 may be provided at a bottom portion or on a side wall portion of the inner storage part 23.

Similar to the wiring board 19*a*, the light-reflection plate 25 covers the wiring board 19*b*, and a cavity is formed in the light-reflection plate 25 at a position of the inner LED light source 27. Thus, like the LED light source 15 as mentioned above, only an emission surface of the inner LED light source 27 is exposed from the cavity to the inner illumination space 29. Also, a light extraction member 31*b* is disposed at a light extraction part that extracts light from the inner illumination space 29. The light extraction member 31*b* is formed of the same material as the light extraction member 31*a*, for example.

Next, the separate extraction part 7 will be described in more details. The separate extraction part 7 has an optical guiding space that forms a bent waveguide, where the sound and light intake port 9*b* is disposed at an angle so as not to be seen from the sound and light extraction port 9*a*. That is, the sound and light extraction space 9*c* forms a bent waveguide. In the illustrated example, a cross sectional shape of the sound and light extraction space 9*c* that forms the bent waveguide is in a substantially U shape. This can make intensity of light extracted from the light extraction part 5 stronger than luminance of light extracted from the separate extraction part 7. Furthermore, bending the sound and light extraction space 9*c* with an angle of 90 degrees or less against a propagation direction of sound and light can make sure that light guided from the inside does not emit directly to the outside from the sound and light extraction port 9*a* of the separate extraction part 7.

Inner surfaces of the separate extraction part 7 and the sound and light extraction space 9*c* may be formed of light reflecting members. This allows light guiding through the sound and light extraction space 9*c* to be reflected efficiently. Also, the inner surfaces of the sound and light extraction space 9*c* in the separate extraction part 7 may be formed of light absorbing members. This allows light guiding through the sound and light extraction space 9*c* to be absorbed efficiently.

As above, by setting a shape of the sound and light extraction space 9*c* suitably and setting a length of the sound and light extraction space 9*c* longer than widths of the sound and light intake port 9*b* and sound and light extraction port 9*a* so as to be in a long and narrow bent shape, light from the LED light source 15 entering the sound and light intake port 9*b* can be reflected multiple times inside the sound and light extraction space 9*c* until being extracted from the sound and light extraction port 9*a*. Also, by forming the inner surfaces of light absorbing or light reflecting members and repeatedly reflecting and absorbing light inside the sound and light extraction space 9*c*, the luminance (brightness) of light extracted from the sound and light extraction port 9*a* can be controlled, or set to zero.

Also, a width of the sound and light intake port 9*b*, a widths of the sound and light extraction port 9*a*, and a width of the sound and light extraction space 9*c* connecting the sound and light intake port 9*b* with the sound and light extraction port 9*a* of the separate extraction part 7 are all set to be larger than a wavelength of light from the LED light source 15 and smaller than a wavelength of sound taken out of the sound source 17. In further details, the width of the sound and light intake port 9*b*, the width of the sound and light extraction port 9*a*, and the width of the sound and light extraction space 9*c* connecting the sound and light intake port 9*b* with the sound and light extraction port 9*a* of the separate extraction part 7 are all set to be between 2 to 10 mm, which is equal to or less than a wavelength of sound wave in a human audible range. This enables to prevent the sound taken out of the sound extraction port 9*a* from interfering with each other inside the sound and light extraction space. Also, a distance between the sound intake port 9*b* and the sound extraction port 9*a* of the separate extraction part 7 is formed to be at least five times the size of the widths of the sound intake port 9*b* and the sound extraction port 9*a*.

Here, if the distance between the sound and light intake port 9*b* and the sound and light extraction port 9*a* is formed to be at least five times the size of the widths of the sound and light intake port 9*b* and the sound and light extraction port 9*a*, light entering the sound and light intake port 9*b* at an angle of 45° to a normal line direction thereof can be reflected approximately four or five times in the waveguide space between the sound and light intake port 9*b* and the sound and light extraction port 9*a*, for example. Thus, because of absorption of light at the time of reflection of the light, the intensity of the extracted light can be reduced. At this time, further preferably, the distance between the sound and light intake port 9*b* and the sound and light extraction port 9*a* is set to be at least six times or more and ten times or less, or more preferably, eight times or more and ten times or less, of the size of the widths of the sound and light intake port 9*b* and the sound and light extraction port 9*a*. This is preferable because this can increase the number of times of reflection while travelling through the waveguide space toward the light extraction port even if the angle of the light entering the sound and light intake port 9*b* against the normal line direction of the light and sound intake port 9*b* is further decreased.

Here, the width of the sound and light intake port 9*b*, the width of the sound and light extraction port 9*a*, and the width of the sound and light extraction space 9*c* connecting the sound and light intake port 9*b* with the sound and light extraction port 9*a* are all sufficiently larger than wavelengths of visible light between 450 nm and 650 nm, and it is unnecessary to take light-quantum-mechanical confinement effect or the like into consideration. On the other hand, the frequency within an audible range of acoustic vibration of human voice is between 20 Hz and 20 kHz, and a speed of sound at a room temperature of 20° C. is approximately 343 m/sec. Thus, the wavelength at this time is between 17.1 m and 1.71 cm. Thus, if the width of the opening portion is set to be approximately 10 mm or less, the widths of the sound and light intake port 9*b*, the sound and light extraction port 9*a*, and the sound and light extraction space 9*c* connecting the sound and light intake port 9*b* with the sound and light extraction port 9*a* are shorter than this wavelength. Preferably, the width of the opening portion is 8 mm or less, or more preferably, 5 mm or less, which is equal to or less than a half wavelength.

In this way, it is possible to prevent the sound waves from interfering with each other and being attenuated inside the sound and light extraction space when the sound waves are extracted from the sound and light extraction space. That is, it is possible to prevent the sound extracted from the sound extraction port 9*a* from interfering with each other inside the sound and light extraction space. Also, this space is a bent space, and thus, even if a total length of the space becomes an integral multiple of a predetermined frequency of the sound, standing waves are not produced so that sound is not amplified.

Next, a method for extracting sound and light using an LED illumination device with a speaker function will be described with reference to FIG. 3. As mentioned above, a waveguide space is formed by disposing the inner light-reflection plate 13 and the outer light-reflection plate 11 so as to face each other. Light emitting from the LED light source 15 is reflected multiple times between the outer light-reflection plate 11 and the inner light-reflection plate 13, and the light is extracted from the light extraction part 5 to the outside (an arrow C in the drawing). At this time, since the outer light-reflection plate 11 and the inner light-reflection plate 13 are formed of light-reflection plates with high diffuse reflectivity, it is possible to reduce attenuation of the light inside the waveguide space of the LED illumination device 1 and to make the extracted light uniform. That is, by disposing the LED light source 15 at a substantially center of the waveguide space, the light from the LED light source 15 is diffusively inter-reflected multiple times repeatedly in the bent waveguide between the inner light-reflection plate 13 and the outer light-reflection plate 11 and can be taken out from the light extraction part 5 as uniform indirect light.

On the other hand, as mentioned above, the separate extraction part 7 includes the sound and light extraction space 9*c* formed of a bent waveguide, and this enables to adjust (reduce) an amount of light leaking from the separate extraction part 7. Consequently, this allows the luminance of light extracted from the light extraction part 5 to be stronger than the luminance of light extracted from the separate extraction part 7. For example, it is possible to make the intensity level of the light guided from the inside to the separate extraction part 7 extremely low so as not to emit directly to the outside from the light and sound extraction port 9*a*.

On the other hand, the sound source 17 is attached to the outer light-reflection plate 11, which serves as a vibration plate. The sound source 17 vibrates the outer light-reflection plate 11 so that air inside is acoustically vibrated and this acoustic vibration of air inside the LED illumination device 1 can be directly extracted from the separate extraction part 7 as sound (an arrow E in the drawing). That is, when the sound source 17 is driven, the sound source 17 vibrates the outer light-reflection plate 11, which then functions as an acoustic vibration plate. That is, the sound generated by the vibration of the sound source 17 can be extracted from the separated extraction part 7 directly to the outside of the illumination device. Thus, the sound extracted from the separate extraction part 7 is louder than the sound extracted from the light extraction part 5. At this time, a light transmission member or the like does not block the sound and light extraction space 9*c*, and thus the sound is not muffled.

Here, in the present invention, muffling of sound means lowering of the sound pressure level due to absorption of vibration energy, or interference of the sound that is reflected inside the illumination device. For example, if a separate extraction part is not formed, the inner space of the illumination device does not directly communicate with the outer space of the illumination device, so the sound generated by vibration of the sound source inside the illumination device cannot be extracted directly from the inside of the illumination device to the outside of the illumination device. This means that the frame members or light extraction members of the light extraction part are vibrated, and this vibration vibrates air in front of the illumination device. These members absorb the vibration energy, which reduces the sound pressure level eventually. Also, since it is impossible to directly extract sound from the illumination device, sound reflects and interferes inside the illumination device.

As above, light and sound can be extracted to the front of the LED illumination device 1 from the space for extraction of both acoustic vibration and light. At this time, it is possible to make sure that there is no interference of sound inside the sound and light extraction space. Thus, sound quality of the sound extracted from the LED illumination device 1 is improved, and, since influences from absorption and reflection of the acoustic vibration in the light extraction part 5 of the LED illumination device 1 can be reduced, attenuation of the sound pressure level when considered as a speaker is also reduced. Here, the same effects can be obtained from the LED illumination device 1*g*.

Figure 7:
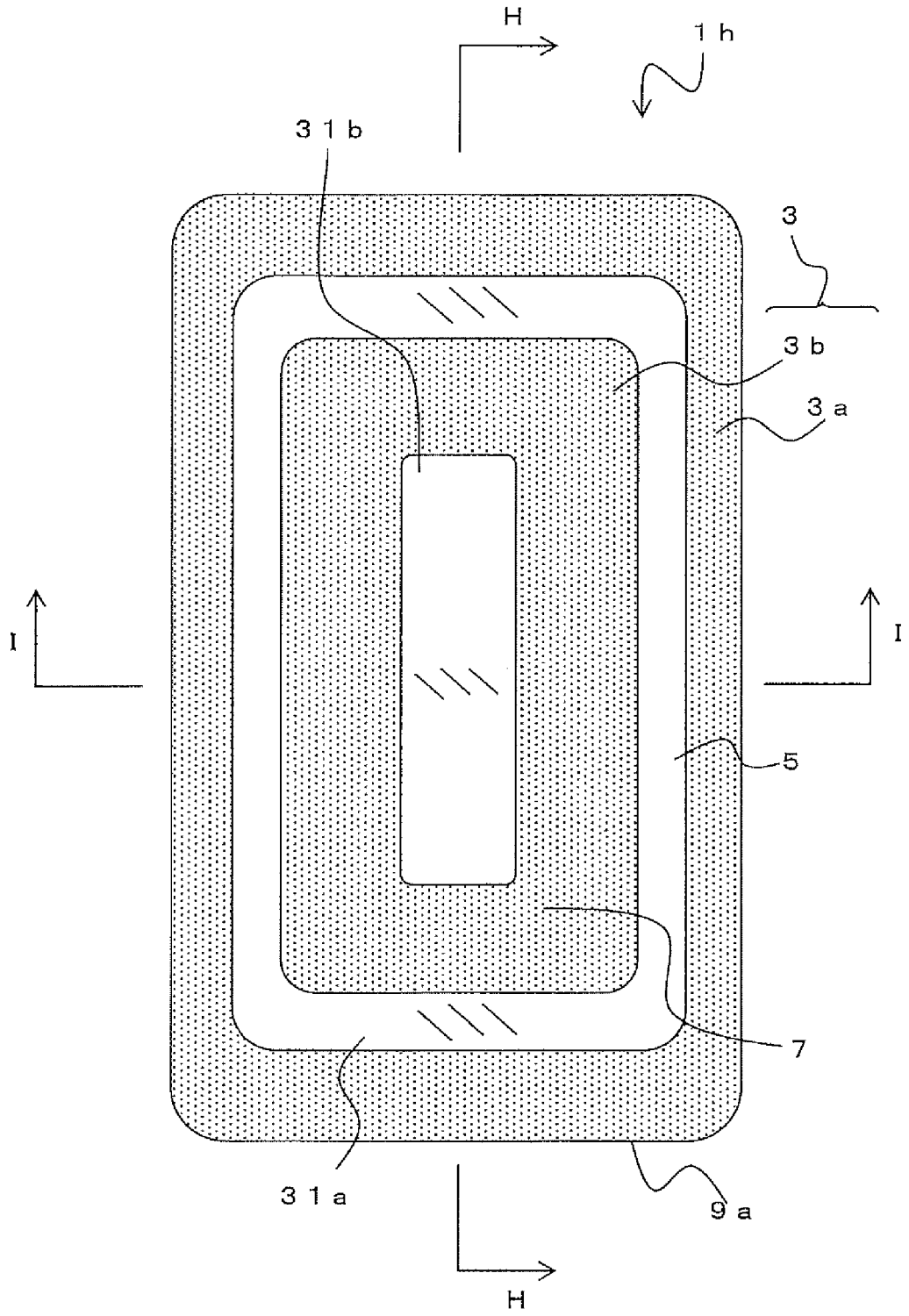
FIG. 7 is a plan view showing an LED illumination device 1*h*.
Figure 8:
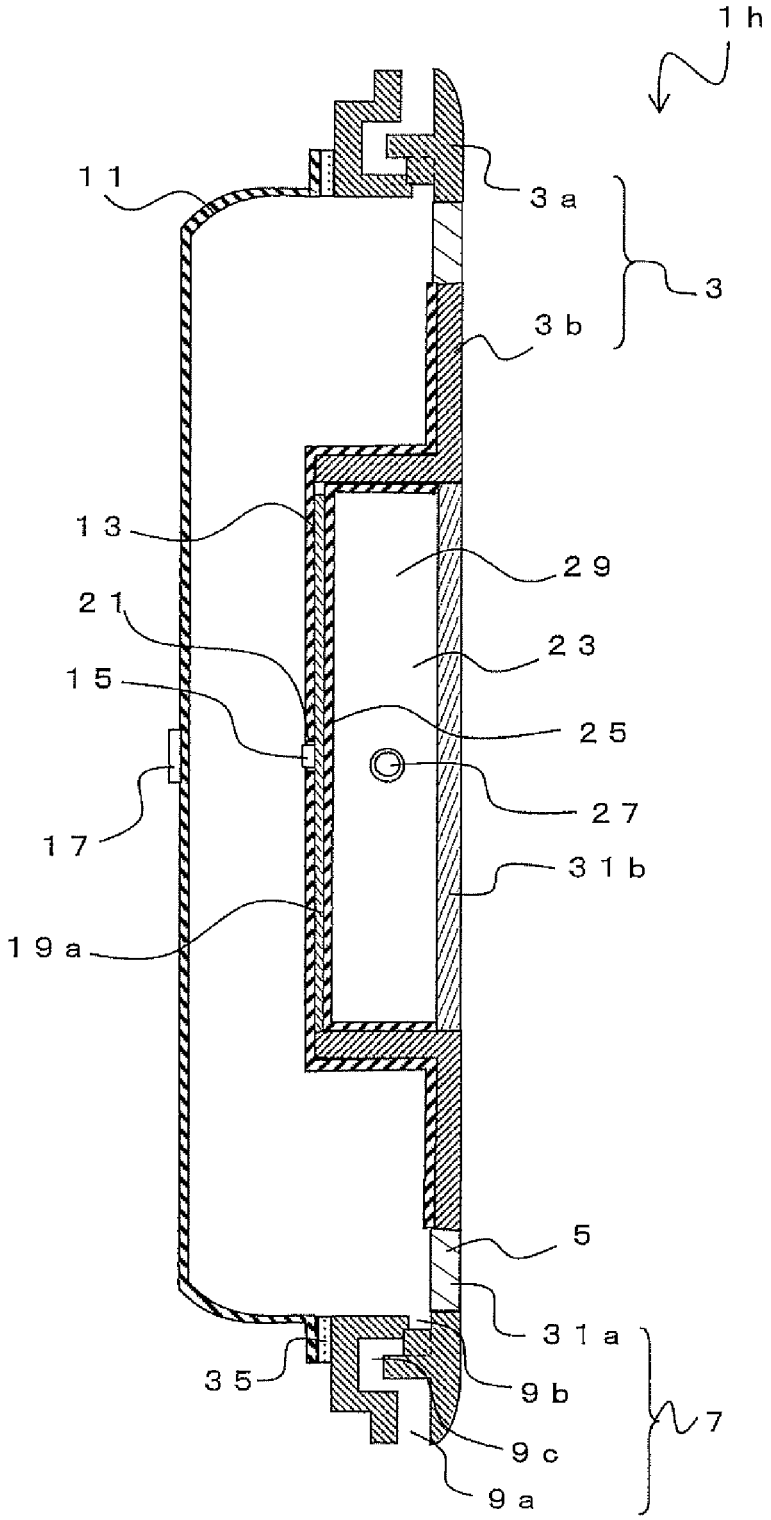
FIG. 8 is a cross sectional view taken along H-H line in FIG. 7.
Figure 9:
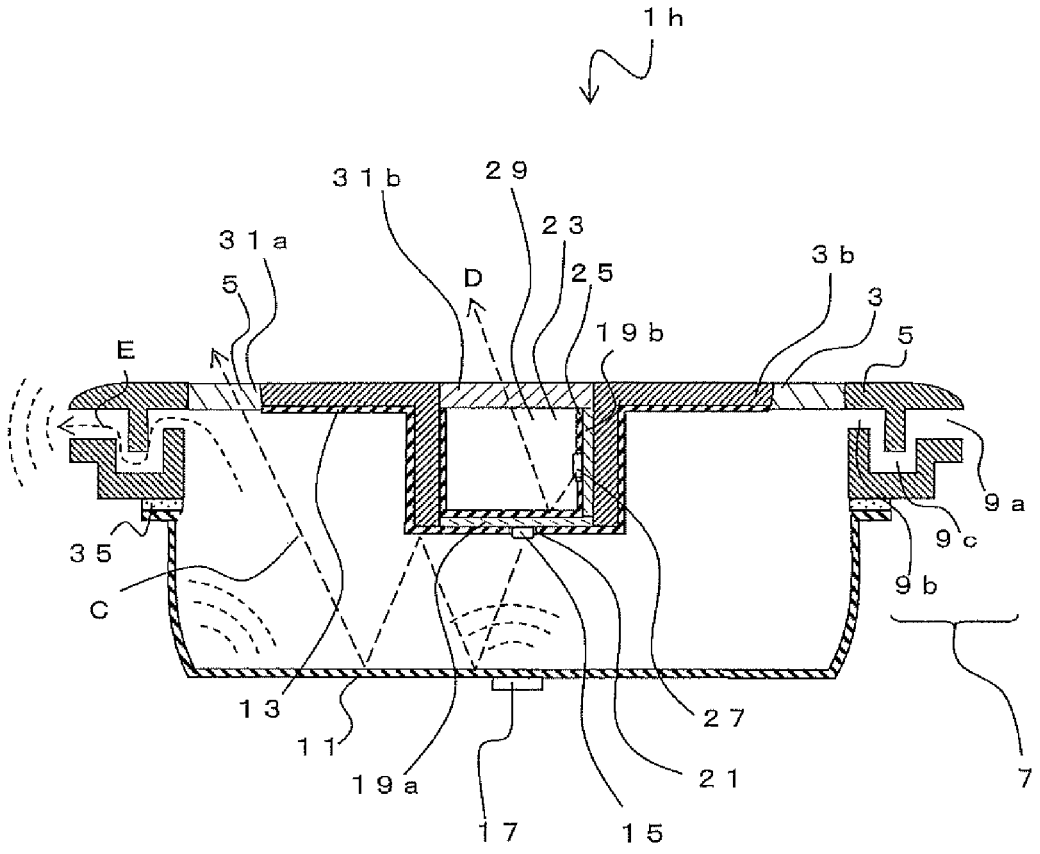
FIG. 9 is a cross sectional view taken along I-I line in FIG. 7.

Although the separate extraction part 7 is disposed facing toward the front of a front surface of the LED illumination device (in the same direction as the light extraction part 5)

in FIG. 1 to FIG. 6, the present invention is not limited thereto. FIG. 7 is a plan view of an LED illumination device 1*h*, FIG. 8 is a cross sectional view taken along H-H line in FIG. 7, and FIG. 9 is a cross sectional view taken along I-I line in FIG. 7. The LED illumination device 1*h* is formed approximately similarly to the LED illumination device 1 except that the separate extraction part 7 is provided on the outer frame part 3*a*.

By providing the separate extraction part 7 on the outer frame part 3*a* like in the LED illumination device 1*h*, similarly to the above-mentioned LED illumination devices, light can be extracted from the light extraction part 5 to all directions. Also, sound can be extracted from the separate extraction part 7 to sides of the LED illumination device. As above, the separate extraction part 7 may be provided on the outer frame part 3*a* or may be provided on the inner frame part 3*b*, and either of the outer frame part 3*a* or the inner frame part 3*b* has the separate extraction part 7. That is, the separate extraction part 7 that extracts sound and light may be provided separately from the light extraction part 5 somewhere in the frame member 3. Also, the separate extraction part 7 may include the sound and light intake port 9*b* on a side of the inner space where the sound source 17 is disposed, and the sound and light extraction port 9*a*, opening toward the outside of the illumination device, on either the outer frame part 3*a* or the inner frame part 3*b*.

The LED illumination device 1 includes the inner LED light source 27 disposed in the inner storage part 23. Light emitted from the inner LED light source 27 is reflected multiple times at the light reflection plate 25, which is an inner surface of the inner illumination space 29, and extracted to the outside (an arrow D in the drawing). In this way, extra light can be extracted separately in addition to the light extracted from the light extraction part 5. For example, using different colors for the LED source light 15 and the inner LED light source 27 can achieve an illumination device that excels in design and decorativeness.

Figure 10A:
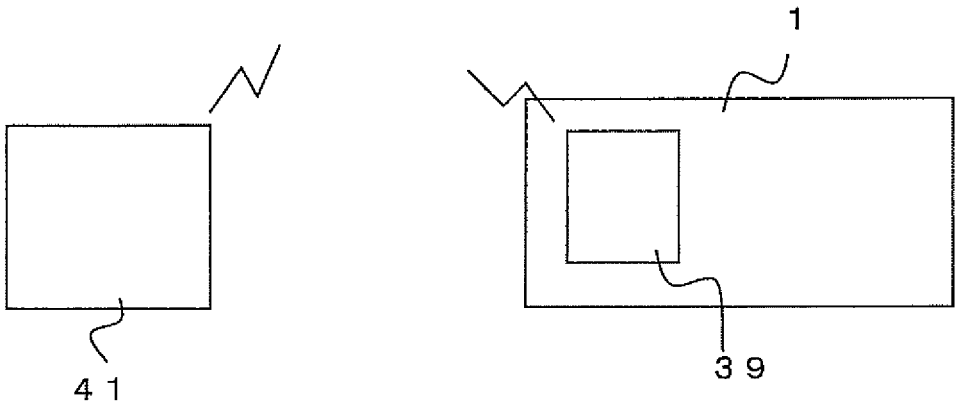
FIG. 10A is a view showing a structure in which the LED illumination device 1 is connected wirelessly with an external signal transmitter 41.

Next, a method for using the LED illumination device 1 will be described. In an example illustrated in FIG. 10A, an internal receiver 39 of the LED illumination device 1 receives voice sound signals or music signals that are wirelessly transmitted from an external signal transmitter 41. An amplifier or an amplifying circuit, which is omitted in the drawing, amplifies the received voice sound signals or music signals. Connecting the receiver 39 with the amplifier or amplifying circuit and with the sound source 17 can vibrate the sound source 17. This then acoustically vibrates the outer light-reflection plate 11 on which the sound source 17 is disposed so that voice sound or music can be extracted.

For the wireless connection, BlueTooth (a registered trademark) can be used, for example. BlueTooth (a registered trademark) is one of the short distance wireless communication technologies used in connecting devices such as mobile information devices. BlueTooth (a registered trademark) can be used, for example, for the devices that are 10 meters or less apart, even if there is an obstruction such as a wall. As above, by connecting the external signal transmitter 41 such as a smartphone with the LED illumination device 1 without using a cable, large capacity data such as voice sound or music can be transmitted and received.

Figure 10B:
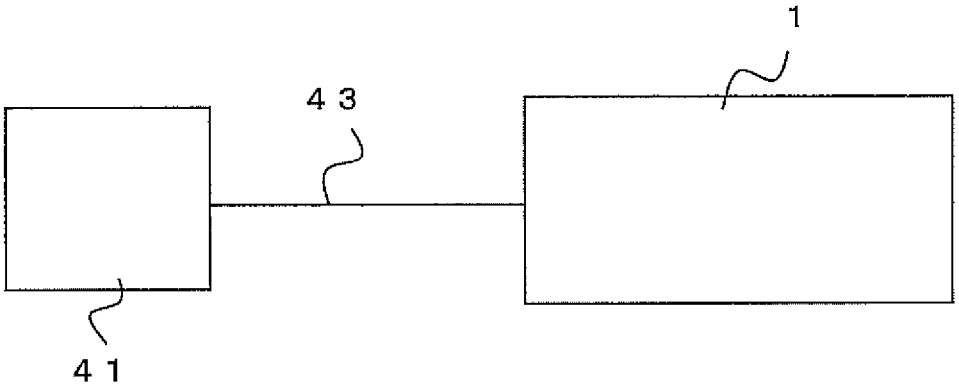
FIG. 10B is a view showing a structure in which the LED illumination device 1 is connected with the external signal transmitter 41 by using a wiring 43.

Alternatively, the wireless communication may not be used for transmitting signals. For example, as shown in FIG. 10B, the external signal transmitter 41 may be connected with the amplifier or amplifying circuit inside the LED illumination device 1 by using a wiring 43. In this case, the amplifier or amplifying circuit amplifies the voice sound signals or music signals transmitted from the external signal transmitter 41. Connecting the amplifier or amplifying circuit with the sound source 17 can vibrate the sound source 17. This then acoustically vibrates the outer light-reflection plate 11 on which the sound source 17 is disposed and the voice sound or music can be extracted. As above, the illumination device includes the wiring 43 or the receiver 39, and when signals from the external signal transmitter 41 are received through the wiring 43 or by the receiver 39, a piezoelectric element or a speaker can output sound voice corresponding to the signals.

As above, according to the present embodiment, since the outer light-reflection plate 11 and the inner light-reflection plate 13 efficiently reflect light from the LED light source 15, light can be extracted uniformly and with high intensity from the light extraction part 5. Also, from the separate extraction part 7, sound generated by vibration of the sound source 17 can be extracted directly to the outside of the illumination device. Thus, muffling of the sound inside the illumination device can be suppressed.

Also, since the cross sectional shape of the sound and light extraction space 9*c* of the separate extraction part 7 is a substantially U shape forming a bent waveguide, light leaking from the separate extraction part 7 can be suppressed. In particular, by setting all of the widths of the sound and light intake port 9*b*, the sound and light extraction port 9*a*, and the sound and light extraction space 9*c* to be larger than a wavelength of light from the LED light source 15 and smaller than a wavelength of sound taken out of the sound source 17, interference and reflection of waves can be suppressed.

Also, since the sound source 17 is disposed on the rear surface side of the LED illumination device 1 and the outer light-reflection plate 11 as a whole serves as a vibration plate, the sound source 17 is not exposed to the surface of the LED illumination device 1. Thus, while keeping the area for the light extraction part 5 and the like, it is possible to have a large vibration region for the sound source 17. Thus, the LED illumination device 1 with a small-sized speaker with good sound quality can be obtained.

Also, since the cavity 21 is provided at the substantially center of the inner light-reflection plate 13 and the LED light source 15 is provided inside the cavity 21 so as to face the outer light-reflection plate 11, it is possible to expose only an emission surface of the LED light source 15 from the cavity 21. Thus, light can be efficiently reflected.

Also, the inner illumination space 29 can be formed by forming the inner storage part 23 inside of the separate extraction part 7, providing the inner LED light source 27 inside the inner storage part 23, and providing the light-reflection plate 25 on the inner surface of the inner storage part 23. In this way, light can be efficiently extracted separately from both the inner illumination space 29 and the light extraction part 5.

Also, if the LED illumination device 1 includes the receiver 39 and the speaker therein can output voice sound corresponding to signals that are transmitted from the external signal transmitter 41 and received by the receiver 39, it is possible to transmit and receive sound voice signals or music signals using a wireless technology such as BlueTooth (a registered trademark). Thus, there is no need to connect the external signal transmitter 41 with the LED illumination device 1 by using a wire.

Also, if the wiring 43 connects the external signal transmitter 41 with the LED illumination device 1, it is still possible for the speaker to output sound voice corresponding to received signals when the signals from the external signal transmitter 41 are received.

If the external signal transmitter 41 is a car stereo or a mobile terminal, the LED illumination device 1 can be used, by interconnecting with the car stereo or the mobile terminal, as a ceiling speaker for the audio system. Also, the external signal transmitter 41 may be, for example, a collision safety device, a drive assist system, or the like that detects information about the front of a car and gives warning for abnormality. When the receiver 39 receives predetermined input signals from the collision safety device or censor information from the drive assist system, the sound source 17 can output warning voice sound or instruction voice sound.

Figure 11:
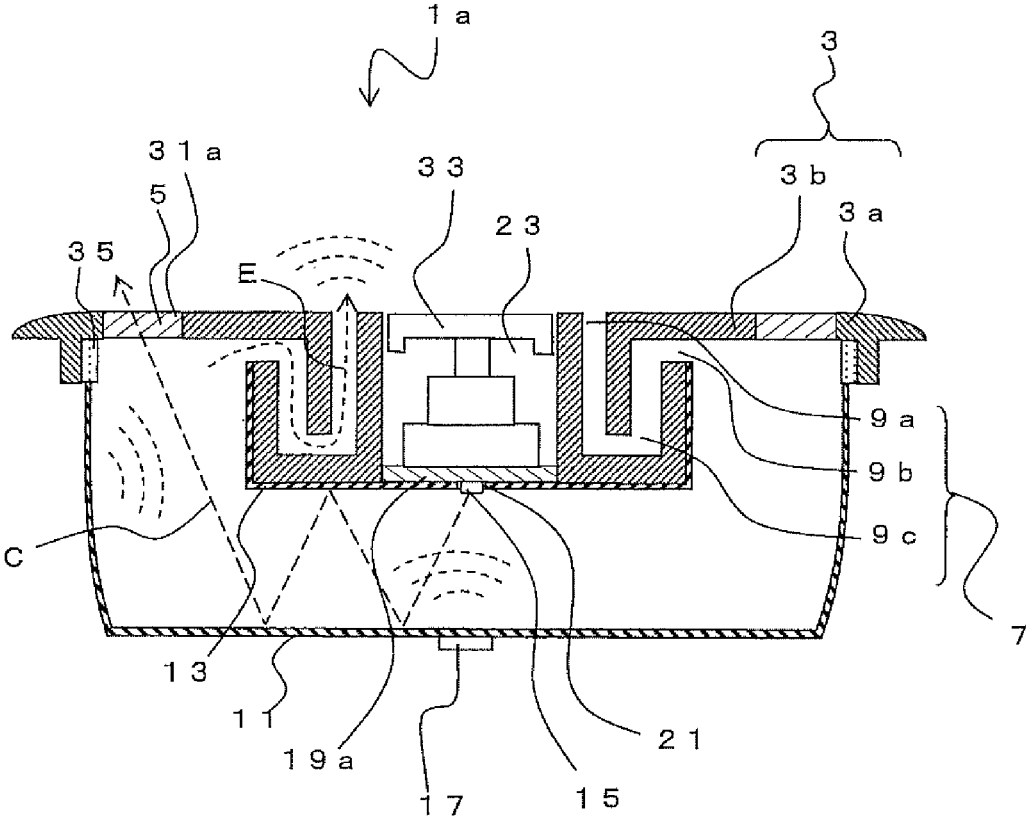
FIG. 11 is a cross sectional view showing an LED illumination device 1*a*.

Next, a second embodiment will be described. FIG. 11 is a cross sectional view showing an LED illumination device 1*a*. In descriptions hereinafter, structures that function similarly as in the LED illumination device 1 will be given the same notations as in FIG. 1 to FIG. 3, and descriptions redundant among the embodiments will be omitted.

The LED illumination device 1*a* has almost the same structure as the LED illumination device 1 except that a switch 33 is disposed inside the inner storage part 23. The switch 33 is, for example, for controlling the LED light source 15 and the like. In this case, the switch 33 is connected with the wiring board 19*a*. The switch 33 can also control the sound source 17 by being connected with the receiver 39 or a driving part of the sound source 17, of which illustrations are omitted in the drawing. It is also possible here that the receiver 39 or the driving part of the sound source 17 are provided as one body with an external power unit for the illumination device.

The switch 33 may be an electrostatic switch instead of a push-type switch. Also, not only one but also a plurality of the switches 33 may be disposed inside the inner storage part 23.

Figure 12:
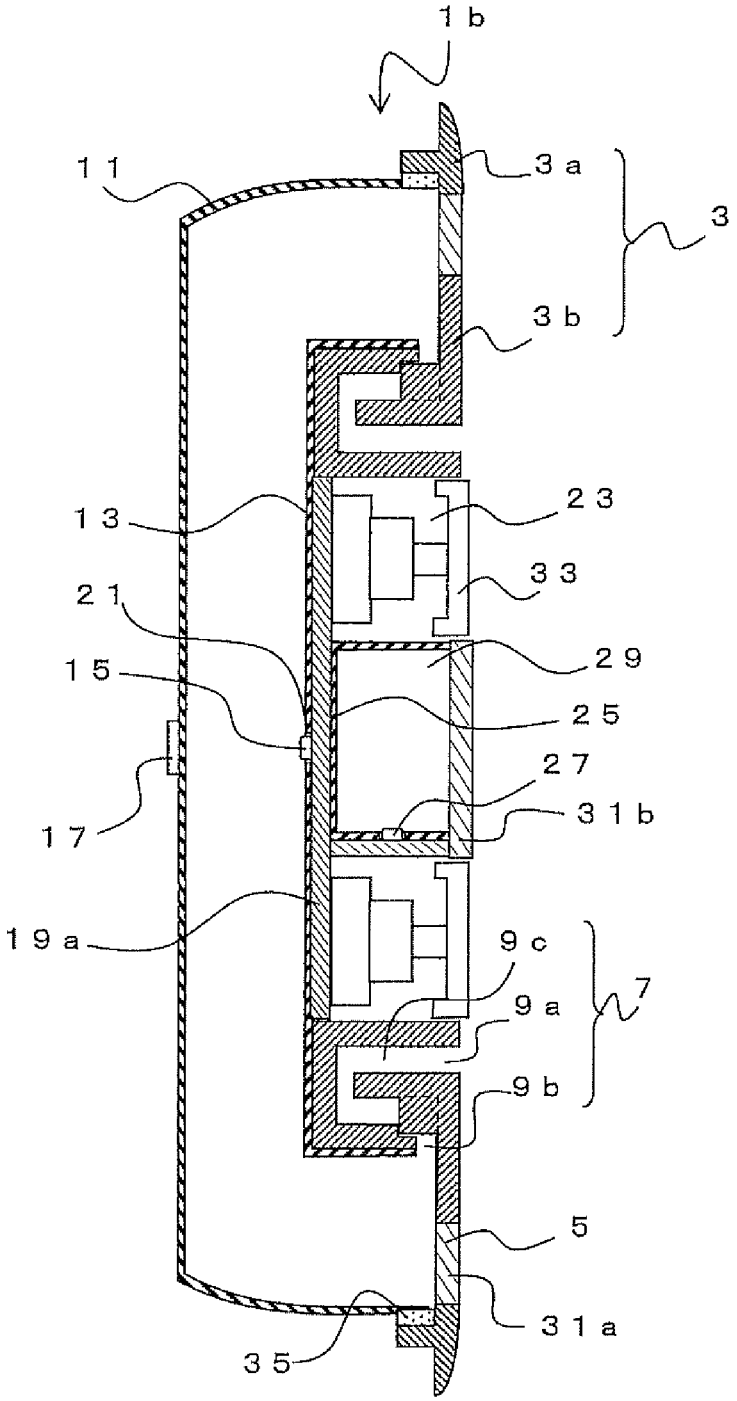
FIG. 12 is a cross sectional view showing an LED illumination device 1*b*.

For example, as shown in an LED illumination device 1*b* in FIG. 12, a plurality of storage sections may be formed for the inner storage part 23 formed inside the separate extraction part 7. In this case, the inner LED light source 27 may be disposed in the storage portion in the center portion, and one or more switches 33 may be disposed in each of the storage portions on the outer sides (both sides of the inner illumination space 29). In this case, the switches 33 can turn on and off the LED light source 15 and the inner LED light source 27. That is, by changing the switches 33, light can be extracted from either the light extraction part 5 or the inner illumination space 29.

According to the second embodiment, the same effects as in the first embodiment can be obtained. As above, inside the inner storage part 23, the inner LED light source 27 may be disposed to form the inner illumination space 29, the switch 33 may be disposed as a controlling portion, and, also, the above may be combined.

Figure 13A:
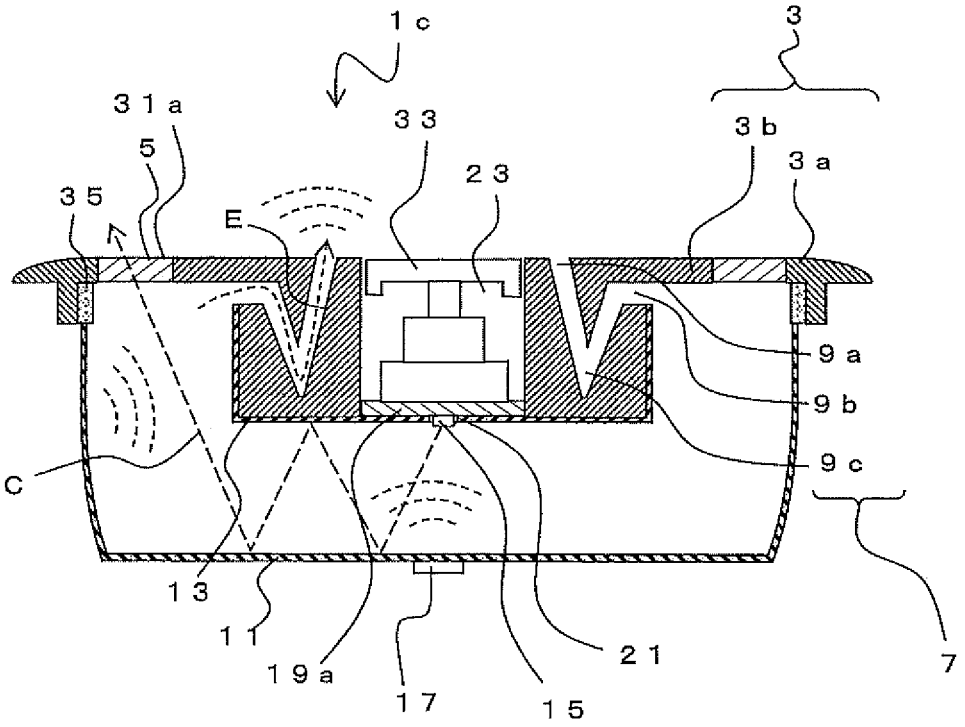
FIG. 13A is a cross sectional view showing an LED illumination device 1*c*.

Next, a third embodiment will be described. FIG. 13A is a cross sectional view showing an LED illumination device 1*c*. In the embodiments hereinafter, a cross sectional view in which the switch 33 is disposed in the inner storage part 23 will be shown. However, the inner LED light source 27 may also be disposed, or the combination of the above may also be acceptable.

The LED illumination device 1*c* has the almost same structure as the LED illumination device 1*a* and the like except that the separate extraction part 7 is in a different shape. The sound and light extraction space 9*c* in the separate extraction part 7 of the LED illumination device 1*c* bends in a substantially V shape. Also in this case, the sound and light intake port 9*b* cannot be seen from the sound and light extraction port 9*a*. Thus, this can suppress light inside from emitting directly to the sound and light extraction port 9*a* and control an amount of guided light by reflection and absorption of light inside the sound and light extraction space 9*c*.

Figure 13B:
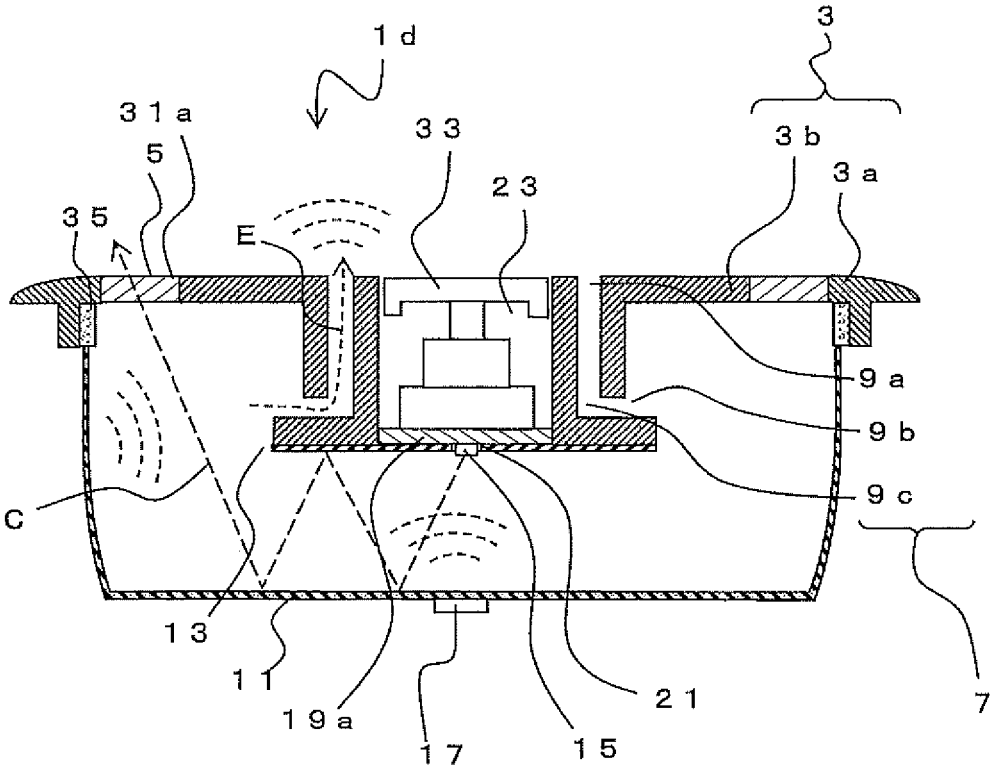
FIG. 13B is a cross sectional view showing an LED illumination device 1*d*.

Similarly, the sound and light extraction space 9*c* in the separate extraction part 7 of an LED illumination device 1*d* shown in FIG. 13B bends in a substantially L shape. Also in this case, the sound and light intake port 9*b* cannot be seen from the sound and light extraction port 9*a*. Thus, this can suppress light inside from emitting directly to the sound and light extraction port 9*a* and control an amount of guided light by reflection and absorption of light inside the sound and light extraction space 9*c*.

According to the third embodiment, the same effects as in the first embodiment will be obtained. As above, the shape of the sound and light extraction space 9*c* is not limited to the U shape, and may be bent with a predetermined angle (90° or more to the propagation direction, for example) to form a bent waveguide in which the sound intake port 9*b* inside cannot be seen directly from the outside. For example, the cross sectional shape of the sound and light extraction space 9*c* that forms a bent waveguide can be any one of an L shape, U shape, V shape, and S shape.

Figure 14A:
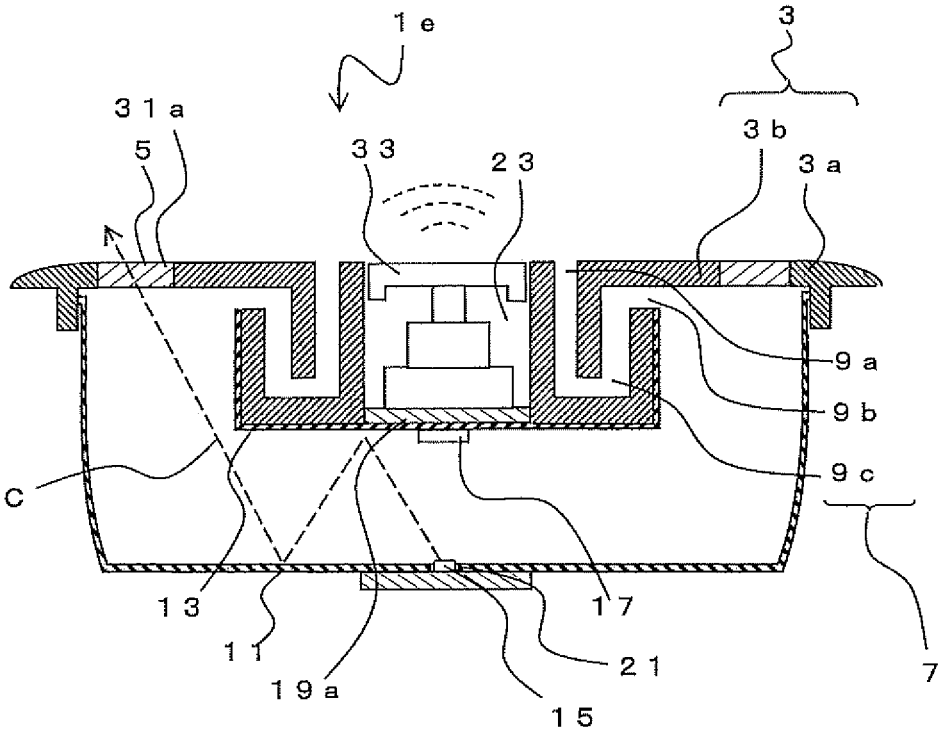
FIG. 14A is a cross sectional view showing an LED illumination device 1*e*.

Next, a fourth embodiment will be described. FIG. 14A is a cross sectional view showing an LED illumination device 1*e*. The LED illumination device 1*e* has almost the same structure as the LED illumination device 1*a* and the like except an arrangement of the LED light source 15 and the sound source 17 is different.

In the LED illumination device 1*e*, the LED light source 15 is disposed at the substantially center of the outer light-reflection plate 11. Also, the sound source 17 is disposed at the substantially center of the inner light-reflection plate 13 so as to face the outer light-reflection plate 11.

In this case, the wiring board 19*a* is disposed on the outer surface side of the outer light-reflection plate 11, and the LED light source 15 is connected with the wiring board 19*a*. Also, the cavity 21 is formed at the substantially center of the outer light-reflection plate 11, and an emission surface of the LED light source 15 is exposed from the cavity 21 to the inner surface of the outer light-reflecting plate 11.

Light emitted from the LED light source 15 is reflected multiple times between the inner light-reflection plate 13 and the outer light-reflection plate 11 and extracted from the light extraction part 5. On the other hand, vibration generated by the sound source 17 vibrates the whole frame member 3 and the outer light-reflection plate 11, and sound is extracted to the front.

According to the fourth embodiment, the same effects as in the first embodiment will be obtained. As above, the sound source 17 may be disposed at the substantially center of either of the reflection plates: the outer light-reflection plate 11 or the inner light-reflection plate 13; and one or more of the LED light source 15 may be provided at the substantially center of the reflection plate on which the sound source 17 is not disposed. That is, the LED light source 15 and the sound source 17 may be disposed at any positions inside a space formed between the facing surfaces of the inner light-reflection plate 13 and the outer light-reflection plate 11 so as to face each other.

Figure 14B:
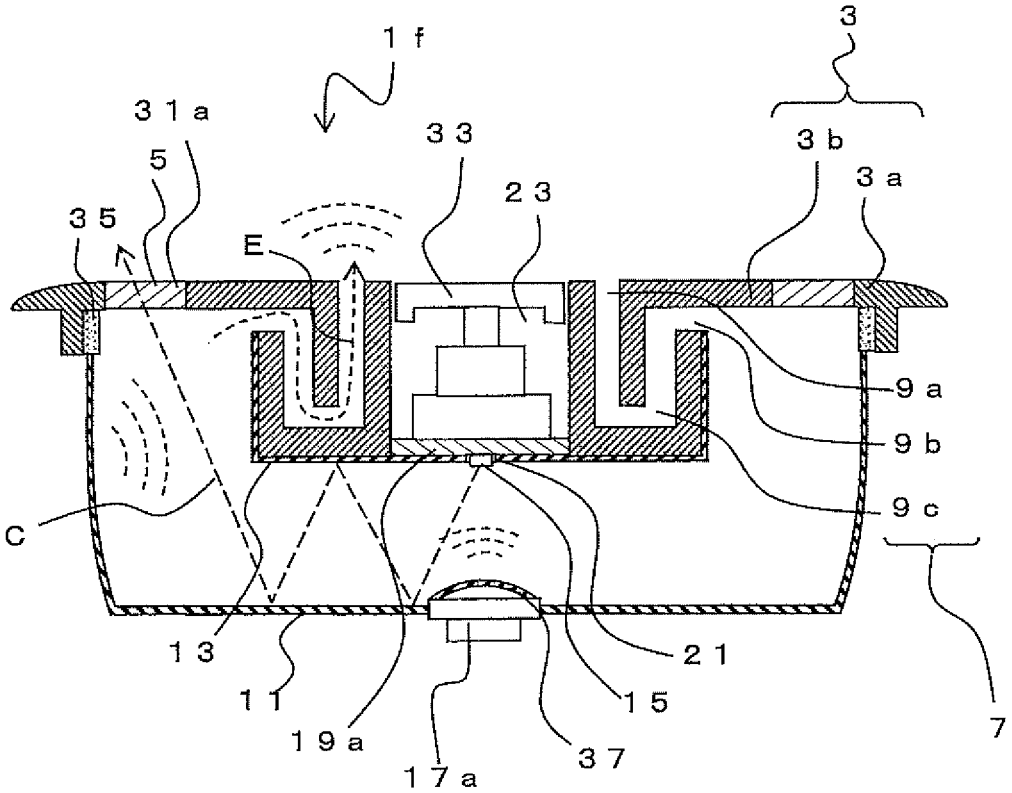
FIG. 14B is a cross sectional view showing an LED illumination device 1*f*.

Next, a fifth embodiment will be described. FIG. 14B is a cross sectional view showing an LED illumination device 1*f*. The LED illumination device 1*f* has almost the same structure as the LED illumination device 1*a* and the like except that a sound source 17*a* is provided in place of the sound source 17.

The sound source 17*a* is disposed at the substantially center of the outer light-reflection plate 11. The sound source 17*a* is a small-sized dynamic speaker. Compared to the case in which the sound source 17 formed of a piezoelectric element is used, the sound quality, especially over low sound range to high sound range, or more particularly in the low sound range, is improved by using the sound source 17*a*.

Also, in this case, a vibration plate 37 for the sound source 17*a* is formed of a micro foam resin plate. In this way, a micro foam resin plate is used as a vibration plate 37 for the sound source 17*a* so as to serve as a reflection plate for the light from the LED source 15.

According to the fifth embodiment, the same effects as in the first embodiment will be obtained. As above, using the sound source 17*a* that is a dynamic speaker can further improve the sound quality. At this time, the vibration plate 37 for the sound source 17*a* is formed of a micro foam resin plate, and this can suppress attenuation of light from the LED light source 15 inside the waveguiding space.

Here, each illumination device has the outer frame part 3*a* in the second to the fifth embodiments shown in FIG. 11 to FIG. 14B as illustrated in each drawing. However, an illumination device having almost the same effects can be obtained without providing the outer frame part 3*a* by extending the light extraction part 5 to the portion of the outer frame part 3*a* and forming a section corresponding to the outer frame part 3*a* and light extraction part 5 from the light extraction member 31*a*.

Although the embodiments of the present invention have been described referring to the attached drawings, the technical scope of the present invention is not limited to the embodiments described above. It is obvious that persons skilled in the art can think out various examples of changes or modifications within the scope of the technical idea disclosed in the claims, and it will be understood that they naturally belong to the technical scope of the present invention.

For example, needless to say, each of the embodiments described above may be combined with one another.

What is claimed is:

1. An LED illumination device with a speaker function, comprising:

an outer light-reflection plate that is in a concave shape having an opening portion, the outer light-reflection plate also serving as an outer frame body;

an inner light-reflection plate that is disposed at a position facing the outer light-reflection plate, the inner light-reflection plate also serving as an inner frame body;

a frame member attached to the opening portion, the frame member being formed with an extraction part from which light is extracted;

an LED light source that is disposed in a space formed between facing surfaces of the inner light-reflection plate and the outer light-reflection plate, and a sound source that is disposed in the space at a position that is different from the position at which the LED light source is disposed, or is disposed on a reverse surface of the outer light-reflection plate, wherein:

the opening portions of the outer light-reflection plate and the inner light-reflection plate are fixed to the frame member; and the frame member inside the illumination device is formed with a separate extraction part that can extract sound and light from an inside to an outside of the illumination device.

2. The LED illumination device with a speaker function according to claim 1, wherein:

either the LED light source and a connection portion of the sound source, to which the sound source directly gives vibration, are disposed facing each other at a substantially center of the space, or the LED light source is disposed at a substantially center of an inner surface of the outer light-reflection plate and the sound source is disposed at a substantially center of an outer surface of the outer light-reflection plate, and the frame member includes an inner frame part, an outer frame part, and a light extraction part;

the light extraction part is formed between the inner frame part and the outer frame part or on outside of the inner flame part so as to adjoin either the inner frame part or the outer frame part;

the opening portion of the outer light-reflection plate is fixed to the outer frame part of the frame member;

the opening portion of the inner light-reflection plate is fixed to the inner frame part;

either the outer frame part or the inner frame part includes the separate extraction part; and the separate extraction part comprises a sound and light extraction space formed inside the illumination device, the sound and light extraction space has a predetermined length, and sound generated by vibration of the sound source can be extracted from the separate extraction part directly to the outside of the illumination device.

3. The LED illumination device with a speaker function according to claim 2, wherein:

the separate extraction part includes a sound and light intake port and a sound and light extraction port either at the outer frame part or at the inner frame part, or on the outside of the inner frame part so as to adjoin the inner frame part, the sound and light intake port being on a side of an inner space in which the sound source and the LED light source are disposed, and the sound and light extraction port opening to the outside of the illumination device; and the sound and light intake port and the sound and light extraction port are formed to be connected continuously being a predetermined distance away from each other.

4. The LED illumination device with a speaker function according to claim 2, wherein the sound source is disposed at a substantially center of one of the outer light-reflection plate and the inner light-reflection plate, and one or a plurality of the LED light sources are provided at a substantially center of either the outer light-reflection plate or the inner light-reflection plate on which the sound source is not disposed.

5. The LED illumination device with a speaker function according to claim 2, wherein the inner light-reflection plate is disposed on a bottom surface of the inner frame part directly or via a circuit board so as to face the outer light-reflection plate.

6. The LED illumination device with a speaker function according to claim 2, wherein the separate extraction part is formed in the inner frame part, an inner storage part is formed inside of the separate extraction part, an inner illumination space is formed provided with a light reflection plate on an inner surface of the inner storage part, an inner LED light source is provided at any position of the inner illumination space, and, furthermore, a light extraction member is disposed at the light extraction part which extracts light from the inner illumination space.

7. The LED illumination device with a speaker function according to claim 2, wherein the separate extraction part is formed in the inner frame part, an inner storage part is formed inside of the separate extraction part, a plurality of storage sections are formed in the inner storage part, an inner LED light source is disposed in the storage section in a center portion, and one or a plurality of switches are disposed in the storage sections on the outer sides.

8. The LED illumination device with a speaker function according to claim 3, wherein the separated extraction part includes a waveguide space that forms a bent waveguide in which the sound and light intake port is disposed at an angle so as not to be seen from the sound and light extraction port, and the separate extraction part inhibits light guided from the inside from emitting directly out of the sound and light extraction port.

9. The LED illumination device with a speaker function according to claim 3, wherein a width of the sound and light intake port, a width of the sound and light extraction port, and a width of the sound and light extraction space connecting the sound and light intake port with the sound and light extraction port in the separate extraction part are all set between 2 and 10 mm, which is larger than a wavelength of light from the LED light source, smaller than a wavelength of sound taken out of the sound source, and equal to or less than a wavelength of a sound wave in a human audible range.

10. The LED illumination device with a speaker function according to claim 2, wherein an inner surface of the sound and light extraction space of the separate extraction part is formed of a light reflection member.

11. The LED illumination device with a speaker function according to claim 2, wherein an inner surface of the sound and light extraction space of the separate extraction part is formed of a light-absorbing member, or an anti-reflection film is formed on the inner surface of the sound and light extraction space.

12. The LED illumination device with a speaker function according to claim 2, wherein luminance of light extracted from the light extraction part is stronger than intensity of light extracted from the separate extraction part, and sound extracted from the separate extraction part is louder than sound extracted from the light extraction part.

13. The LED illumination device with a speaker function according to claim 2, wherein:

the outer light-reflection plate is a light reflection plate made of micro foam resin, which also serves as an acoustic vibration plate;

the outer light-reflection plate is any one of PET resin, PC resin, acrylic resin, and flame-retardant acrylic resin; and when an aluminum oxide light reflection plate is taken as a standard plate, a ratio of light reflectivity of the outer light-reflection plate to that of the aluminum oxide light reflection plate is 90% or more for total reflectivity and 90% or more for diffusive reflectivity.

14. The LED illumination device with a speaker function according to claim 2, wherein the light extraction part is formed, in a planar view, around the inner frame part, in a ring shape or a letter shape of any one of C shape, D shape, E shape, F shape, L shape, H shape, U shape, θ shape, and Π shape, or is formed by facing two ring shapes, D shapes, C shapes, or I shapes to each other.

15. The LED illumination device with a speaker function according to claim 2, wherein the illumination device further comprises a wiring or a receiver so that, when signals transmitted from an external signal transmitter are received by the wiring or the receiver, a piezoelectric element or a speaker can output voice sound corresponding to the signals.

16. The LED illumination device with a speaker function according to claim 2, wherein the illumination device comprises as a sound source a small-sized dynamic speaker disposed at a substantially center of the outer light-reflection plate.

17. A method for extracting light and sound from an LED illumination device with a speaker function, wherein:

the method uses the LED illumination device with a speaker function according to claim 2;

the inner light-reflection plate and the outer light-reflection plate are disposed so as to face each other to form a waveguide space, and light mutually inter-reflected at the inner light-reflection plate and the outer light-reflection plate can be extracted as indirect light from the light extraction part;

a separate extraction part of the illumination device is formed either in the inner frame part or the outer frame part and includes a sound and light intake port, which is on an internal space side where the sound source is disposed, and a sound and light extraction port, which opens toward an outside of the illumination device;

the sound and light intake port and the sound and light extraction port are disposed a predetermined distance away from each other, and the sound and light extraction space that continuously connects together the sound and light intake port and the sound and light extraction port is formed;

the separate extraction part is a waveguide space forming a bent waveguide, in which the sound and light intake port is disposed at an angle so as not to be seen from the sound and light extraction port;

sound generated by vibration of the sound source is extracted through the sound and light extraction space from the separate extraction part directly to the outside; and light from a light source of the illumination device is diffused and reflected in the bent waveguide, and then extracted as indirect light from the bent waveguide of the separate extraction part.

* * * * *